US008200128B2

(12) United States Patent
Oda

(10) Patent No.: US 8,200,128 B2
(45) Date of Patent: Jun. 12, 2012

(54) POWDER MATERIAL AGITATOR AND CARTRIDGE

(75) Inventor: Yukiyoshi Oda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 13/034,156

(22) Filed: Feb. 24, 2011

(65) Prior Publication Data

US 2011/0142494 A1 Jun. 16, 2011

Related U.S. Application Data

(63) Continuation of application No. 11/944,666, filed on Nov. 26, 2007.

(30) Foreign Application Priority Data

Nov. 29, 2006 (JP) ..... 2006-321549

(51) Int. Cl.
*G03G 15/08* (2006.01)

(52) U.S. Cl. ..... 399/263

(58) Field of Classification Search ..... 399/120, 399/263

See application file for complete search history.

(56) References Cited

U.S. PATENT DOCUMENTS 5,548,384 A 8/1996 Weed
5,655,195 A * 8/1997 Ichikawa et al. ..... 399/263
5,722,014 A 2/1998 Fike
5,774,773 A 6/1998 Otsuka et al.
5,812,916 A * 9/1998 Kishimoto et al. ..... 399/263
5,813,761 A * 9/1998 Redl ..... 366/314
5,835,827 A * 11/1998 Kishimoto ..... 399/254
5,835,828 A * 11/1998 Jyoroku ..... 399/256
6,081,676 A 6/2000 Inomata
6,292,644 B1 9/2001 Goto et al.
6,418,290 B1 * 7/2002 Isomura et al. ..... 399/254
6,456,810 B1 9/2002 Deguchi et al.
6,647,235 B2 * 11/2003 Patterson et al. ..... 399/254
6,701,113 B2 * 3/2004 Matsuda et al. ..... 399/263
6,704,533 B2 * 3/2004 Isomura et al. ..... 399/254
6,788,912 B2 * 9/2004 Isomura et al. ..... 399/254
6,839,533 B2 1/2005 Ban et al.

(Continued)

FOREIGN PATENT DOCUMENTS

JP 06242674 A 9/1994

(Continued)

OTHER PUBLICATIONS

Office Action issued May 25, 2011 in U.S. Appl. No. 11/944,666.

*Primary Examiner* — David Gray
*Assistant Examiner* — Geoffrey Evans
(74) *Attorney, Agent, or Firm* — Panitch Schwarze Belisario & Nadel LLP

(57) ABSTRACT

A powder material cartridge includes a shaft and a sheet-holding member. The shaft extends in a longitudinal direction and is rotatable about a longitudinal axis. The sheet-holding member is formed on the rotatable shaft and holds one end of the sheet member. The sheet-holding member includes a first portion that extends substantially parallel to the shaft and a second portion that extends at an angle with the shaft such that the second portion extends in a direction away from the shaft so that the sheet member includes a third portion that extends substantially parallel to the shaft and a fourth portion that extends at an angle with the shaft.

13 Claims, 20 Drawing Sheets

U.S. PATENT DOCUMENTS

| | | | | |
|---|---|---|---|---|
| 6,853,828 | B2 * | 2/2005 | Ban et al. | 399/258 |
| 7,260,346 | B2 * | 8/2007 | Himes | 399/262 |
| 7,426,356 | B2 | 9/2008 | Ota | |
| 7,532,843 | B2 * | 5/2009 | Kern et al. | 399/254 |
| 7,742,726 | B2 * | 6/2010 | Mase et al. | 399/263 |
| 7,899,367 | B2 * | 3/2011 | Fukuta | 399/254 |
| 2001/0046395 | A1 * | 11/2001 | Ashikari et al. | 399/262 |
| 2002/0025183 | A1 * | 2/2002 | Murakami et al. | 399/109 |
| 2002/0150410 | A1 * | 10/2002 | Matsuda et al. | 399/263 |
| 2004/0223790 | A1 | 11/2004 | Hosokawa et al. | |
| 2005/0220498 | A1 | 10/2005 | Ito | |
| 2005/0244189 | A1 | 11/2005 | Kimura et al. | |
| 2009/0087227 | A1 * | 4/2009 | Takagi et al. | 399/263 |
| 2011/0103846 | A1 * | 5/2011 | Ota | 399/263 |

FOREIGN PATENT DOCUMENTS

| | | | |
|---|---|---|---|
| JP | 08123176 | A | 5/1996 |
| JP | 09160456 | A | 6/1997 |
| JP | 09274352 | A | 10/1997 |
| JP | 2004085894 | A | 3/2004 |
| JP | 2005018039 | A | 1/2005 |
| JP | 2005189523 | A | 7/2005 |
| JP | 2006139070 | A | 6/2006 |
| JP | 2006284776 | A | 10/2006 |

* cited by examiner

CLOSING POSITION

OPENING POSITION

FIG.21A

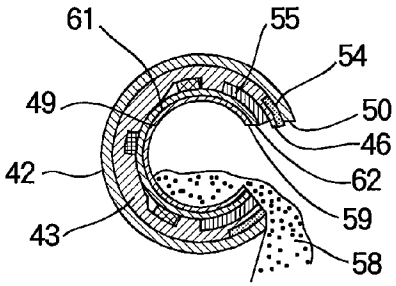

WHEN WASTE TONER 58 IS DISCHARGED THROUGH WASTE TONER DISCHARGING OPENING 59 INTO CYLINDER 42

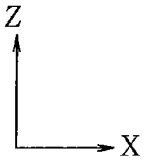

FIG.21B

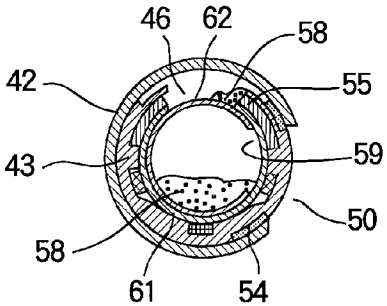

WHEN ROTARY DRIVE SHUTTER IS ROTATED TO CLOSE WASTE TONER RECEIVING OPENING 50 AFTER DISCHARGING WASTE TONER

FIG.21C

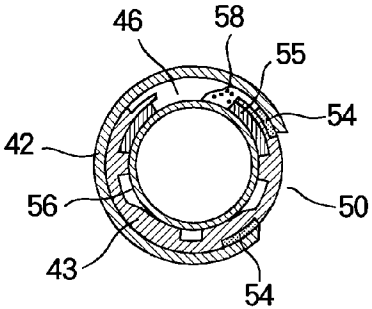

WHEN WASTE TONER DISCHARGING SECTION 49 IS DRAWN OUT FROM CYLINDER 42 (IF RECIPROCATING SHUTTER 56 IS EMPLOYED)

FIG.21D

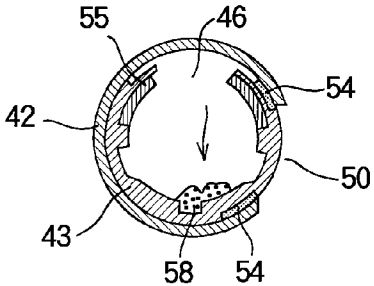

WHEN WASTE TONER DISCHARGING SECTION 49 IS DRAWN OUT FROM CYLINDER 42 (IF RECIPROCATING SHUTTER 56 IS NOT EMPLOYED)

FIG.24A

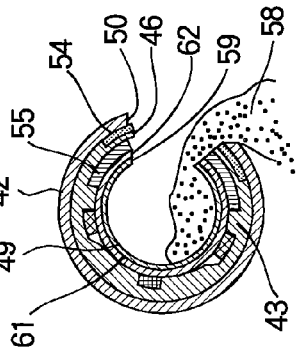

WHEN WASTE TONER 58 IS DISCHARGED THROUGH WASTE TONER DISCHARGING OPENING 59 INTO CYLINDER 42

FIG.24B

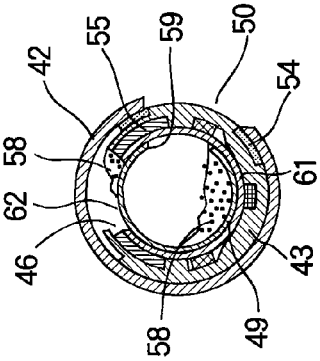

WHEN ROTARY DRIVE SHUTTER IS ROTATED TO CLOSE WASTE TONER RECEIVING OPENING 50 AFTER DISCHARGING WASTE TONER

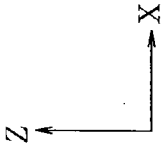

FIG.24C

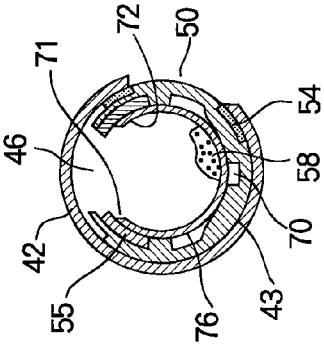

WHEN WASTE TONER DISCHARGING SECTION 49 IS DRAWN OUT FROM CYLINDER 42 (IF RECIPROCATING SHUTTER 56 IS EMPLOYED)

FIG.24D

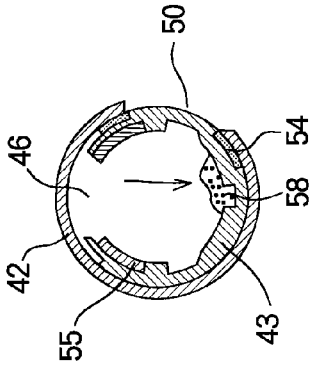

WHEN WASTE TONER DISCHARGING SECTION 49 IS DRAWN OUT FROM CYLINDER 42 (IF RECIPROCATING SHUTTER 56 IS NOT EMPLOYED)

CLOSING POSITION

OPENING POSITION

POWDER MATERIAL AGITATOR AND CARTRIDGE

CROSS-REFERENCE TO RELATED APPLICATIONS

This application is a continuation of copending U.S. application Ser. No. 11/944,666 filed Nov. 26, 2007, the entire disclosure of which is incorporated herein by reference.

BACKGROUND OF THE INVENTION

1. Field of the Invention

The present invention relates to a powder material cartridge that holds a developer (e.g., toner) and that is used in an image forming apparatus including a copying machine, a printer, and facsimile machine. The invention further relates to an image forming section to which the material powder cartridge is attached, and an image forming apparatus that incorporates the image forming section.

2. Description of the Related Art

Image forming apparatuses such as an electrophotographic printer, a copying machine, and a facsimile machine use an electrophotographic image forming process including steps of charging, exposing, developing, transferring, and fixing. A charging roller charges the surface of a photoconductive drum uniformly. An exposing unit employs a light source such as LEDs or a laser, and selectively illuminates the charged surface of the photoconductive drum to form an electrostatic latent image. A developing unit supplies toner to the electrostatic latent image, thereby developing the electrostatic latent image with the toner into a toner image. The toner image is then transferred onto a print medium, and finally fused by a fixing unit into a permanent image. A small amount of toner may remain on the photoconductive drum after transferring the toner image onto the print medium. The residual toner may be removed by a cleaning unit from the photoconductive drum. The residual toner is then transported and is collected as a waste toner into a waste toner collecting chamber.

A toner cartridge includes a fresh toner chamber that holds fresh toner and a waste toner chamber that holds the waste toner. The waste toner chamber includes a waste toner receiving opening through which the waste toner is received from a waste toner transporting unit. The waste toner chamber includes a lid that closes and opens the waste toner receiving opening. The waste toner transporting unit includes a lid that closes and opens the waste toner discharging opening. When the toner cartridge has not been attached to the image forming section of the image forming apparatus, the lid continues to close the waste toner discharging opening, thereby preventing the waste toner from spilling through the waste toner discharging opening of the waste toner transporting unit.

For example, the lid mounted to the waste toner discharging opening on the waste toner transporting unit side and the lid mounted to the waste toner discharging opening on the waste toner chamber side are opened when the toner cartridge is attached to the image forming section, and are closed when the toner cartridge is detached from the image forming section.

When the waste toner chamber holds a large amount of waste toner such that the waste toner piles up near the waste toner receiving opening, the waste toner may accidentally spill on the surrounding components in the image forming section.

SUMMARY OF THE INVENTION

An object of the invention is to provide a powder cartridge, an image forming section, and an image forming apparatus that prevents toner spillage when a developer cartridge is attached to or detached from the image forming section.

A powder material cartridge includes a powder material chamber, a receiving section, a first shutter, and a second shutter. The powder material chamber holds a powder material therein. The receiving section is provided in the powder material chamber, and includes a first opening formed therein through which the powder material is received into the powder material chamber. The first shutter is rotatably received in the receiving section, and includes a second opening formed therein. The first shutter is rotatable either to a first opening position where the second opening is in alignment with the first opening, or to a first closing position where the second opening is not in alignment with the first opening. The second shutter is received in the first shutter, and is slidable straight in the first shutter. When the second shutter slides to a second closing position, the second shutter closes the second opening. When the second shutter slides to a second opening position, the second shutter opens the second opening.

The receiving section includes a first generally cylindrical inner space, and the first shutter includes a first generally cylindrical outer surface, the first shutter being rotatably received in the first generally cylindrical inner space.

The second shutter includes a second generally cylindrical outer surface, and the first shutter includes a second generally cylindrical inner space.

The second shutter includes a first engagement portion formed on the second generally cylindrical outer surface. The first shutter includes an inner surface in which a second engagement portion is formed. The first engagement portion loosely fits the second engagement portion such that the second shutter is guided in the first shutter.

The powder material is a first powder material and the powder material chamber is a first powder material chamber. The powder material cartridge further comprises a second powder material chamber that holds a second powder material therein.

The powder material is a waste developer material.

An image forming section incorporates the aforementioned powder material cartridge.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein:

FIGS. 21A-21D illustrate the waste toner that is transported between the waste toner discharging section of the main body and the waste toner chamber of the toner cartridge;

FIGS. 24A-24D illustrate waste toner that is transported between a waste toner discharging section of a main body and a waste toner chamber of the toner cartridge.

DETAILED DESCRIPTION OF THE INVENTION

First Embodiment

{Image Forming Apparatus}

Figure 1:
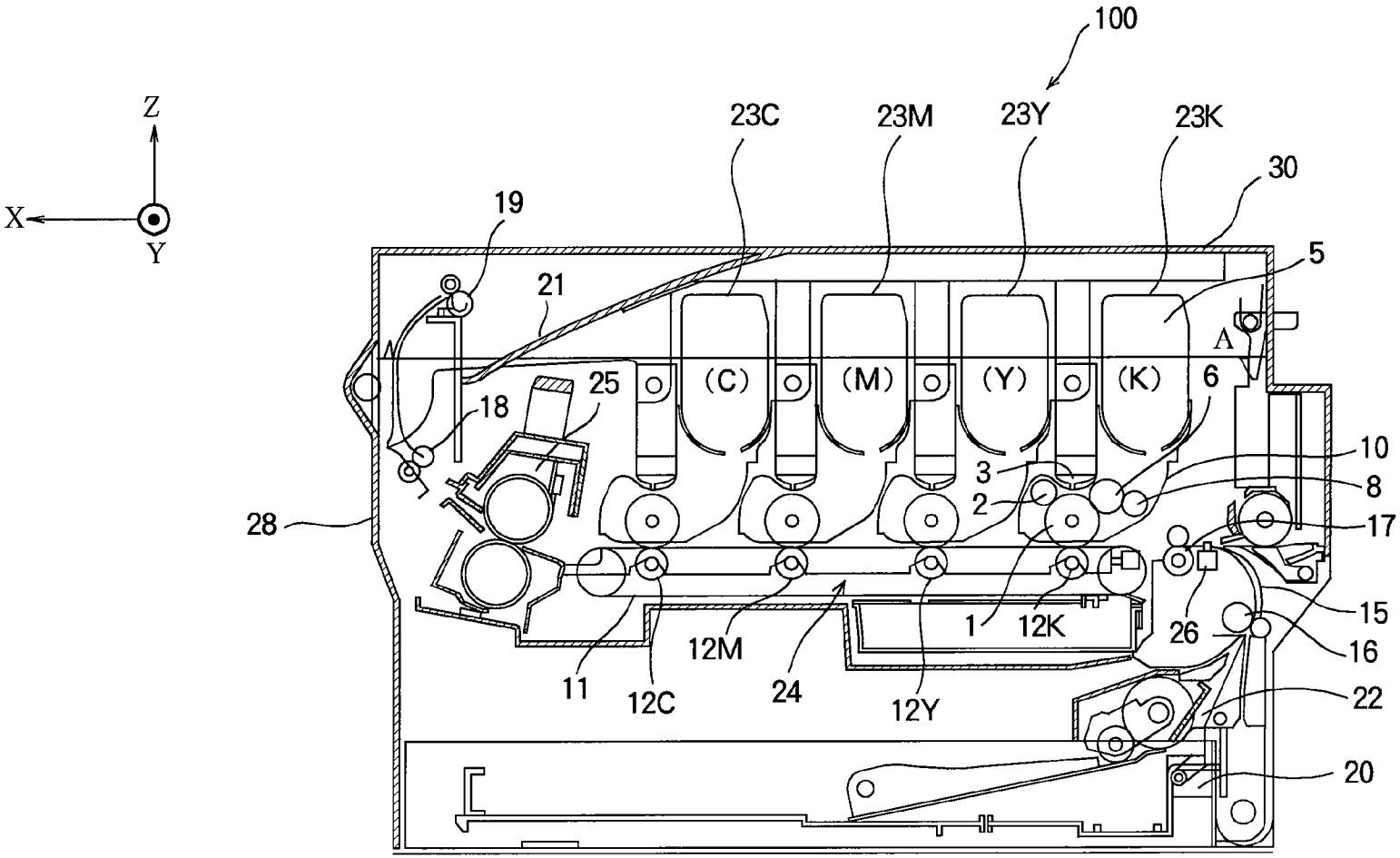
FIG. 1 illustrates a general configuration of an image forming apparatus of the invention.

FIG. 1 illustrates a general configuration of an image forming apparatus of the invention to which a toner cartridge according to the invention is attached.

An image forming apparatus 100 is an electrophotographic printer capable of performing full color printing (black, yellow, magenta, and cyan). A lower frame 28 supports a transport path 15 generally in the shape of an elongated "S," and includes transport rollers 16-19. A medium cassette 20 holds a stack of print medium such as paper and OHP, and is disposed at an upstream end of the transport path 15. A stacker 21 is disposed at a downstream end of the transport path 15.

A medium feeding mechanism 22, a detector 26, a belt unit 24, and a fixing unit 25 are disposed along the transport path 15. The medium feeding mechanism 22 feeds the print paper from the medium cassette 20 into the transport path 15. The detector 26 detects the thickness of the print paper. The belt unit 24 includes a transfer belt 11 that attracts the print paper by the electrostatic force. The transfer belt 11 is driven to run through the image forming sections 23K, 23Y, 23M, and 23C. The fixing unit 25 fixes the toner image on the print paper.

Image forming sections 23K (black), 23Y (yellow), 23M (magenta), and 23C (cyan) are disposed from upstream to downstream in this order such that the transfer belt 11 is sandwiched between the belt unit 24 and the image forming sections 23K, 23Y, 23M, and 23C. The image forming sections 23K, 23Y, 23M, and 23C are detachably attached to the image forming apparatus. The image forming sections 23K, 23Y, 23M, and 23C are of the same construction and differ only in color. Thus, for simplicity, a description will be given only of the black image forming section 23K, it being understood that other sections may function in a similar way.

{Image Forming Section}

Figure 2:
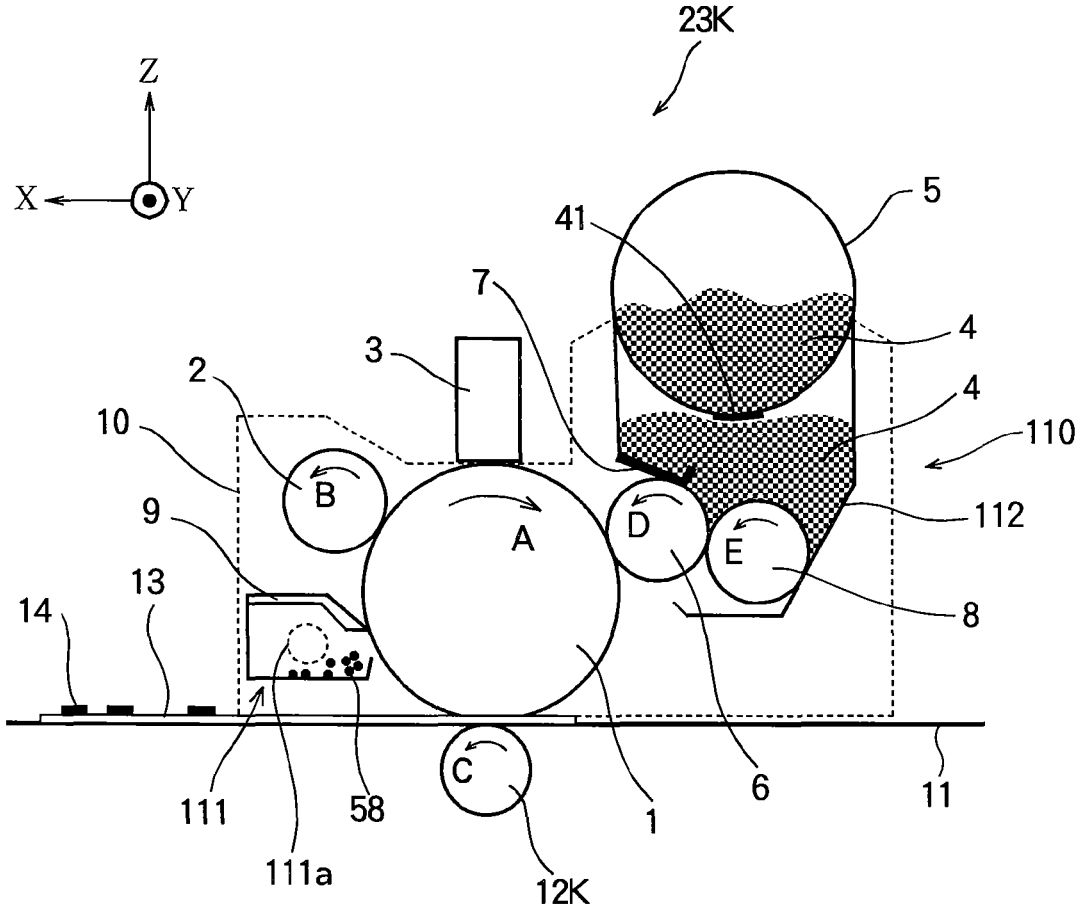
FIG. 2 illustrates a general configuration of the image forming section for black (enclosed by a dotted line), an exposing unit, and a transfer unit.

FIG. 2 illustrates a general configuration of the image forming section 23K (enclosed by a dotted line), an exposing unit 3, and a transfer unit such as a transfer roller.

Referring to FIG. 2, a photoconductor such as photoconductive drum 1 rotates in a direction shown by arrow A. A charging unit including a charging roller 2, the exposing unit 3, a developing unit 110 including a developing roller 6, and a cleaning unit including a cleaning blade 9 are disposed around the photoconductive drum 1 from upstream to downstream with respect to rotation the photoconductive drum 1. The charging roller 2 rotates in a direction shown by arrow B in contact with the photoconductive drum 1 to charge the surface of the photoconductive drum 1. The exposing unit 3 takes the form of, for example, an LED print head that illuminates the charged surface of the photoconductive drum 1. The exposing unit 3 is mounted to an upper cover 30 of the image forming apparatus 100.

A developing unit 110 includes the developing roller 6 that rotates in contact with the photoconductive drum 1 to supply black toner 4 to an electrostatic latent image formed on the surface of the photoconductive drum 1, thereby developing the electrostatic latent image into a black toner image. The cleaning blade 9 scrapes the residual black toner off the photoconductive drum 1. The cleaning blade 9 is formed of a resilient body, and includes an edge in pressure contact with the surface of the photoconductive drum 1. A drive source (not shown) transmits driving forces to the aforementioned rotating components through, for example, gears (not shown).

The developing unit 110 includes a toner cartridge 5, a toner reservoir 112, the developing roller 6, a toner supplying roller 8, and a developing blade 7. The toner cartridge 5 holds the toner 4, and supplies the toner 4 through a toner discharging opening 41 into the toner reservoir 112. The toner reservoir 112 receives the toner from the toner cartridge 5 and holds the toner 4 therein. The developing blade 7 forms a thin layer of the toner 4 on the developing roller 6. The developing roller 6 supplies the toner 4 to the electrostatic latent image formed on the surface of the photoconductive drum 1. The toner cartridge 5 is detachably attached to the developing unit 10 such that the toner 4 discharged from the toner cartridge 5 falls into the toner supplying roller 8.

The developing roller 6 and the toner supplying roller 8 are in pressure contact with each other, and rotate in directions shown by arrows D and E, respectively. The developing blade 7 extends in parallel with the developing roller 6, and includes a bent free end portion such that the bent end portion is in pressure contact with the developing roller 6. A drive source (not shown) transmits driving forces to the rotating components of the developing unit through, for example, gears (not shown).

Referring to FIG. 1, transfer rollers 12K, 12Y, 12M, and 12C extend in parallel to the photoconductive drums 1 of the respective image forming sections 23K, 23Y, 23M, and 23C, with the transfer belt 11 sandwiched between the transfer rollers 12K, 12Y, 12M, and 12C and image forming sections 23K, 23Y, 23M, and 23C. The transfer rollers 12K, 12Y, 12M, and 12C are formed of, for example, an electrically conductive rubber material. A transfer voltage is applied to the respective transfer rollers 12K, 12Y, 12M, and 12C to create an electric field by which the toner images on the respective photoconductive drum 1 are transferred onto the print paper 13.

The fixing unit 25 includes a heat roller and a backup roller in contact with each other to define a fixing point between the hear roller and the backup roller. When the print paper 13 passes through the fixing point, the toner images of the respective colors on the print paper 13 are fused into a permanent full color image under heat and pressure. The print paper 13 is then advanced by transport rollers 18 and 19 and is discharged onto the stacker 21.

{Toner Cartridge}

A description will be given of a structure of the toner cartridge 5 and how the toner cartridge 5 is attached to and detached from the image forming section 23.

Figure 3:
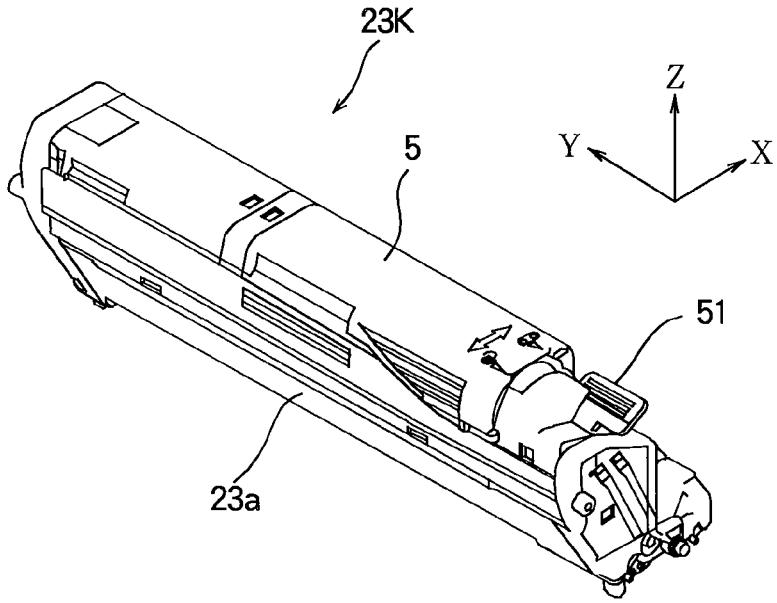
FIGS. 3 and 4 are perspective views of the image forming section as seen from different directions.
Figure 4:
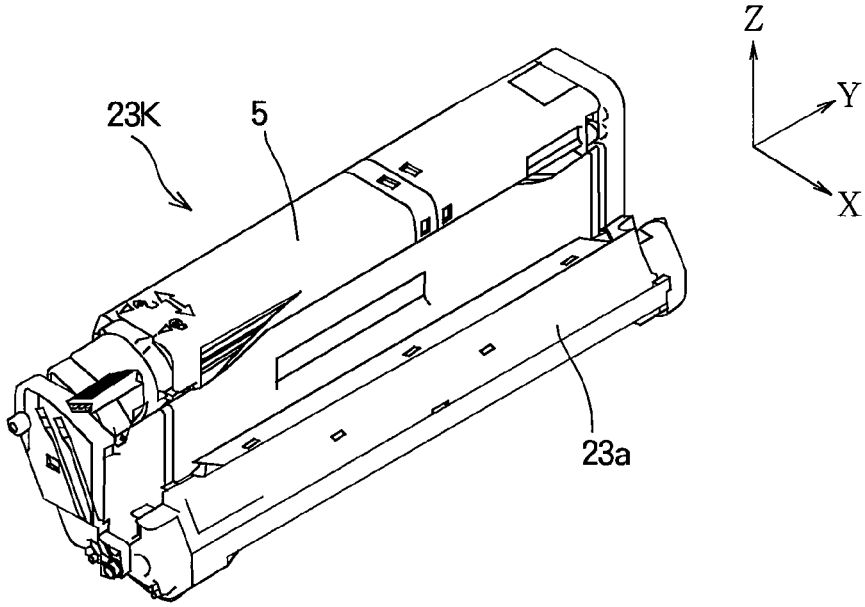
Figure 5:
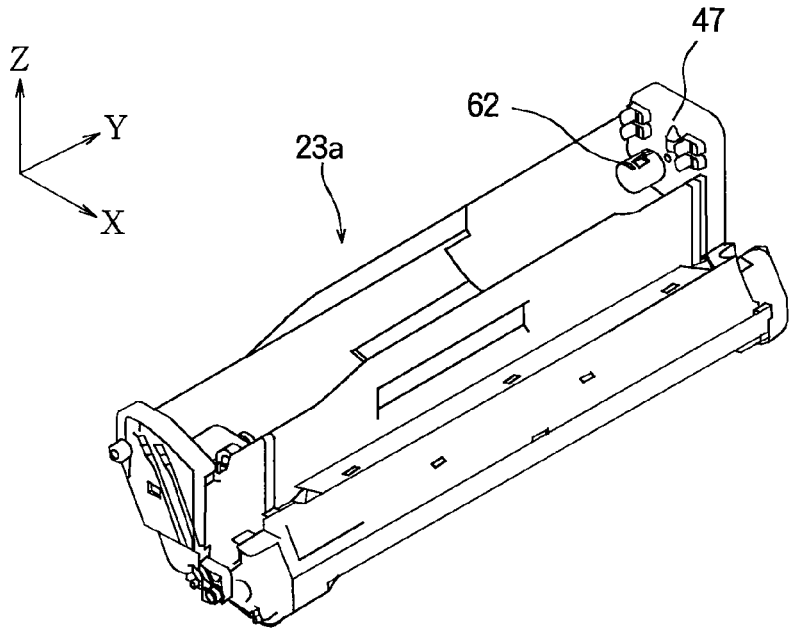
FIGS. 5-7 are perspective views of a main body of the image forming section.
Figure 6:
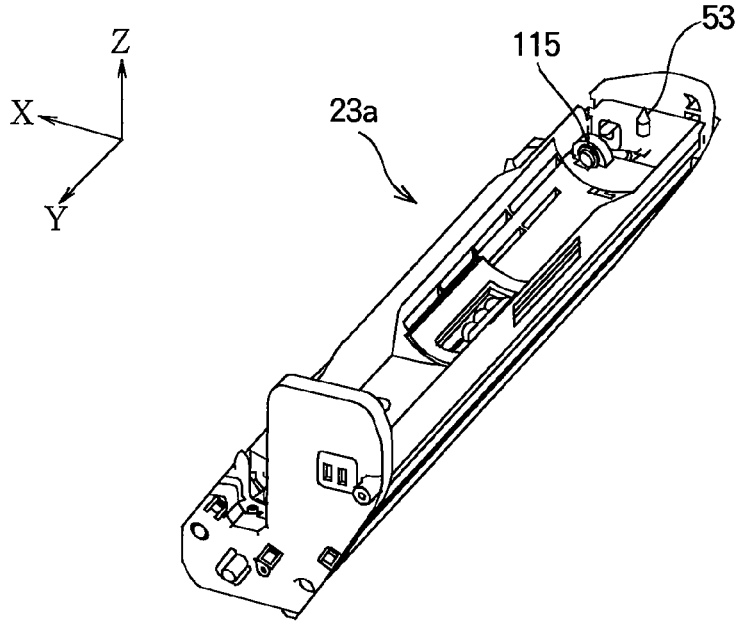
Figure 7:
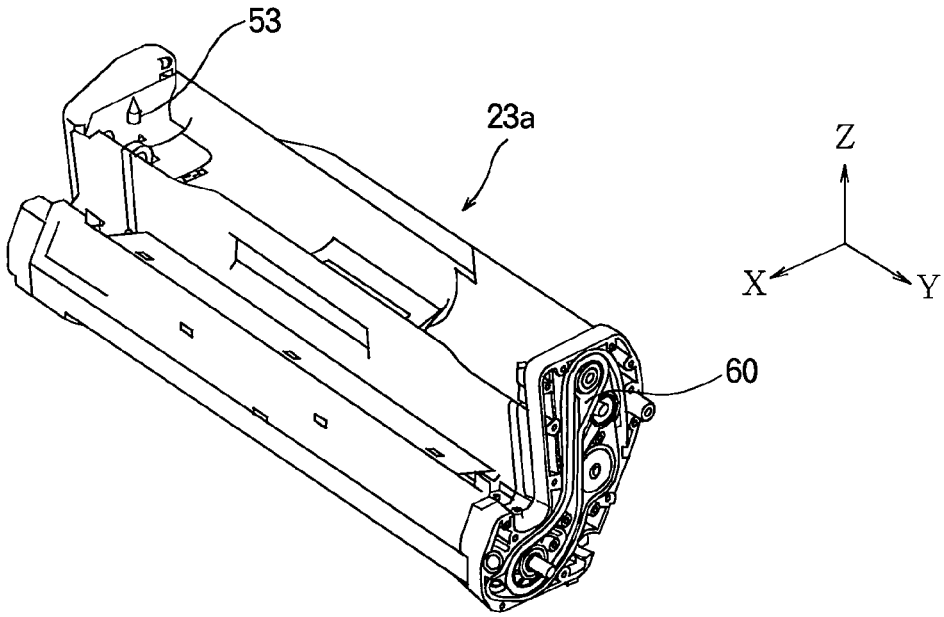
Figure 8:
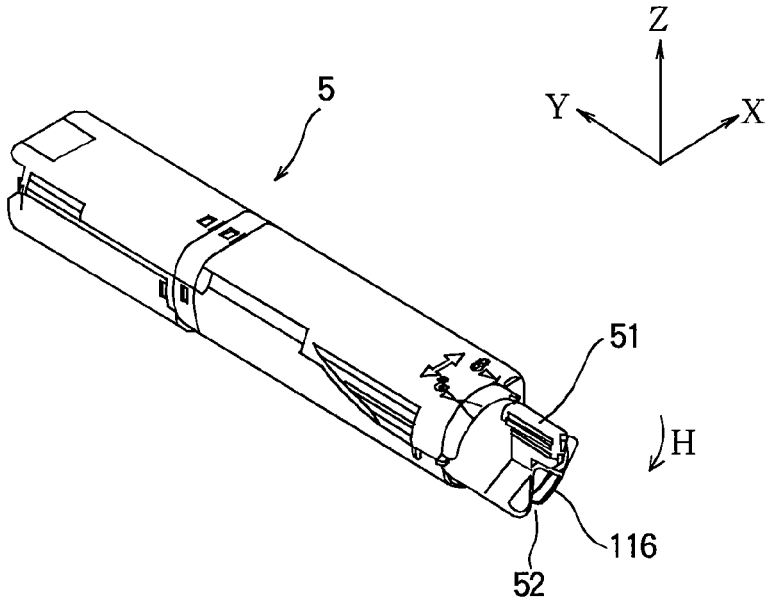
FIGS. 8-10 are perspective views of the toner cartridge as seen from different directions.
Figure 9:
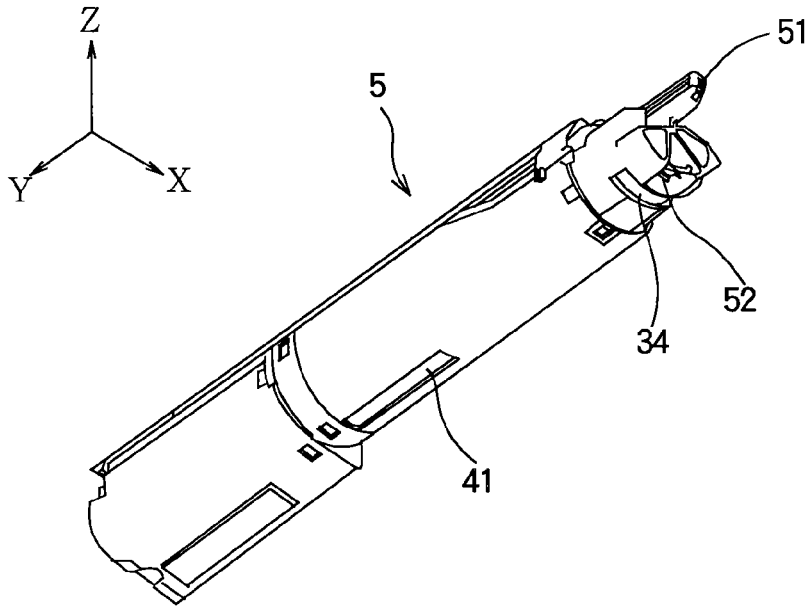
Figure 10:
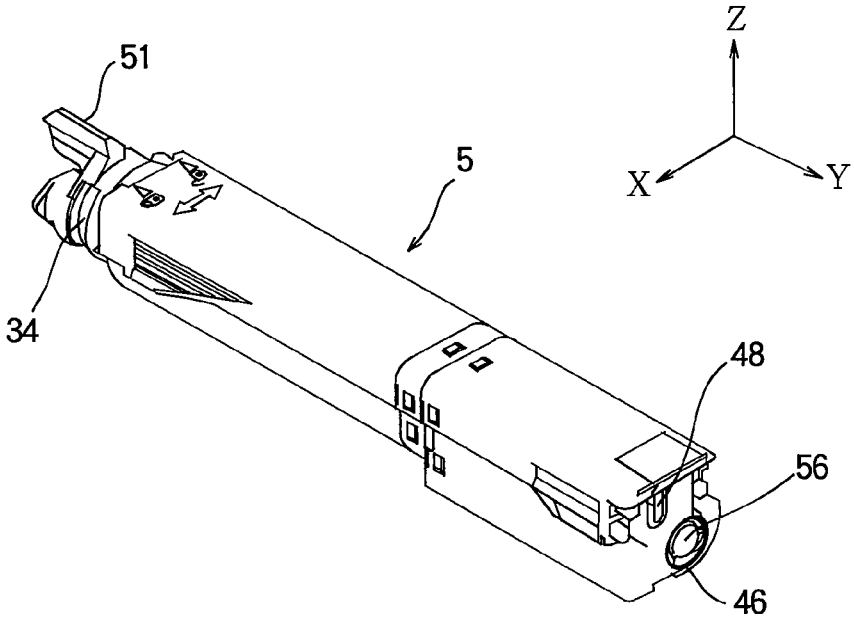

FIGS. 3 and 4 are perspective views of the image forming section 23K as seen from different directions. FIGS. 5-7 are perspective views of a main body 23*a* of the image forming section 23. FIGS. 8-10 are perspective views of the toner cartridge 5 as seen from different directions.

Figure 11A:
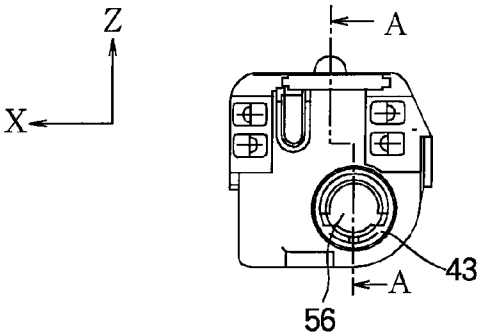
FIG. 11A is a side view of the toner cartridge.

FIG. 11A is a side view of the toner cartridge 5.

Figure 11B:
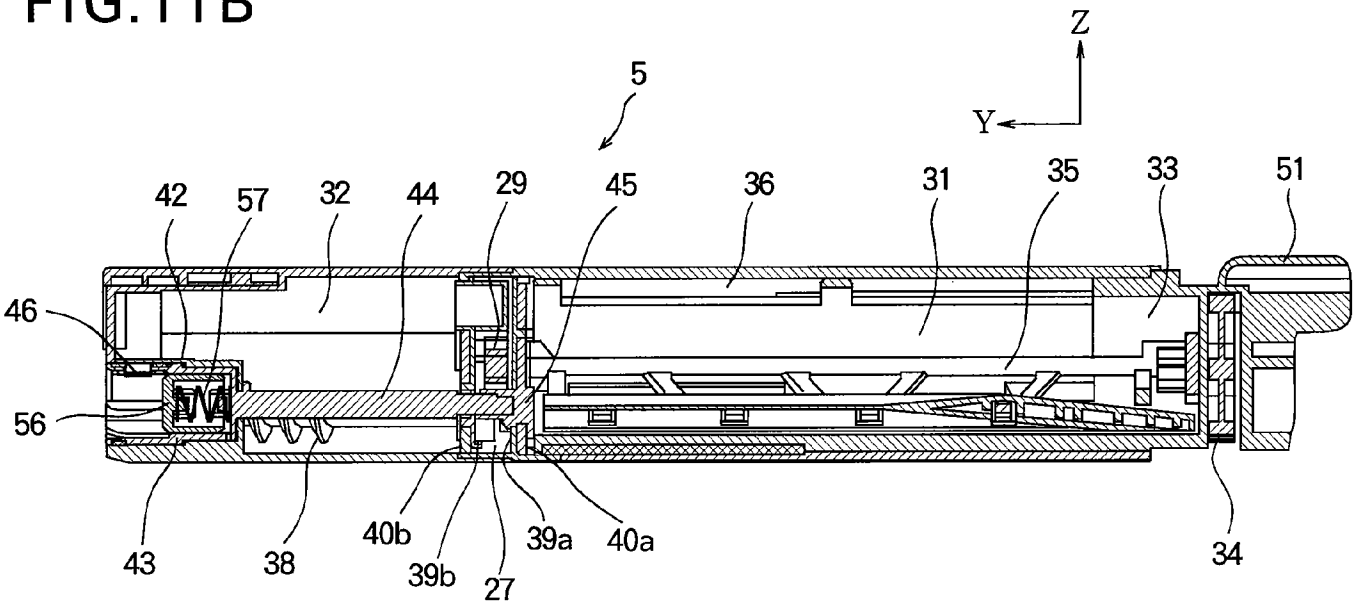
FIG. 11B is a longitudinal cross-sectional view of the toner cartridge taken along a line 12A-12A of FIG. 11A.

FIG. 11B is a longitudinal cross-sectional view of the toner cartridge 5 taken along a line 12A-12A of FIG. 11A.

Figure 12A:
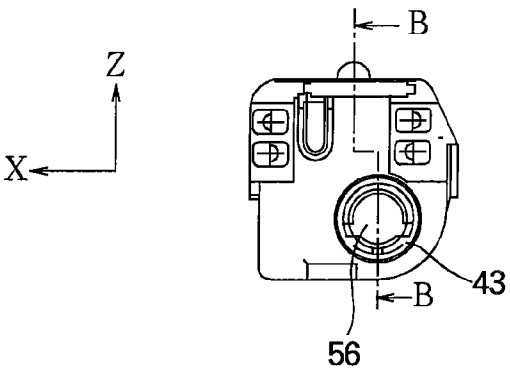
FIG. 12A is a side view of the toner cartridge.

FIG. 12A is a side view of the toner cartridge 5.

Figure 12B:
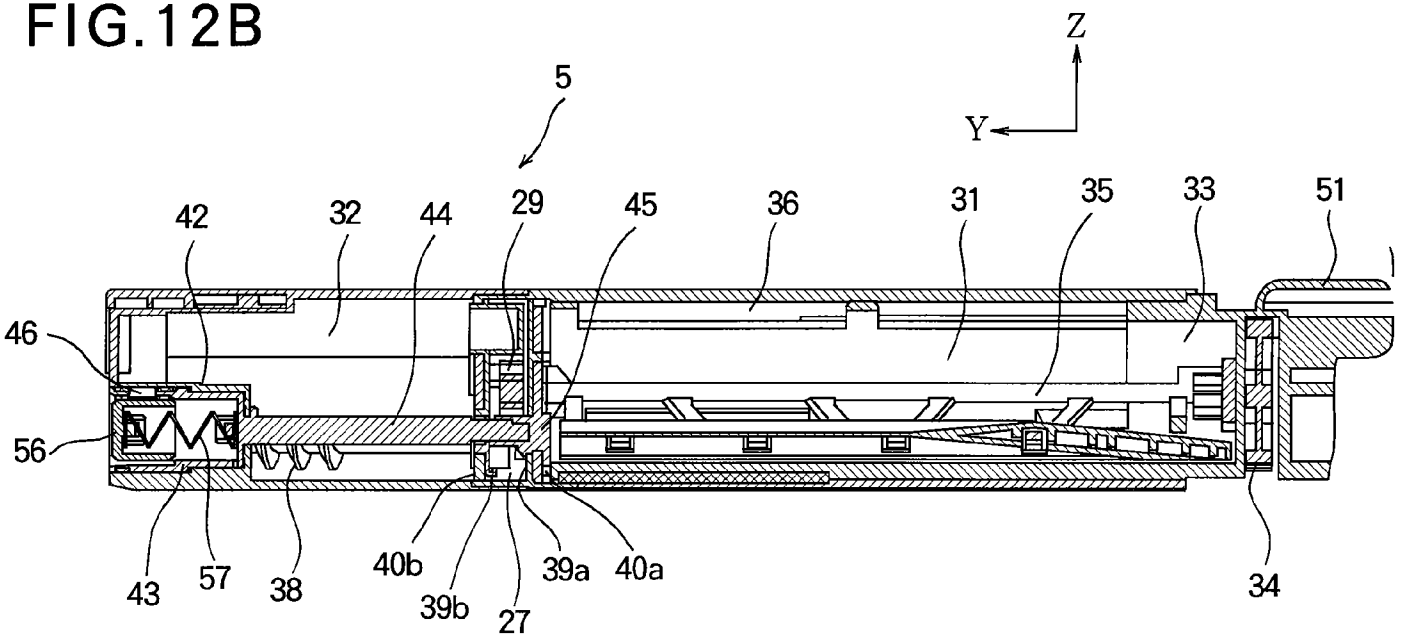
FIG. 12B is a longitudinal cross-sectional view of the toner cartridge taken along a line 12B-12B of FIG. 12A.

FIG. 12B is a longitudinal cross-sectional view of the toner cartridge 5 taken along a line 12B-12B of FIG. 12A.

Referring to FIG. 12B, the toner cartridge 5 includes a fresh toner chamber 31, a waste toner chamber 32, and a gear box 27 disposed between the fresh toner chamber 31 and the waste toner chamber 32. The fresh toner chamber 31 holds a powder material, for example, fresh toner therein. The waste toner chamber 32 holds a powder material, for example, waste toner therein. The toner cartridge 5 includes a fresh toner shutter 33, a gear 34 that meshes with a drive gear 115 (FIG. 6) to receive a rotational force, an agitator 35 that rotates together with the gear 34, and a resilient sheet member 37 (FIGS. 13A-13B) that is mounted to the agitator 35 to scrape the toner from an inner wall 36. A lever 51 is disposed outside of the toner cartridge 5 at a longitudinal end of the toner cartridge 5, and is coupled to the fresh toner shutter 33 (which will be described later).

{Agitator}

FIGS. 13A-13F illustrate the construction of the agitator 35 and the sheet member 37.

Figure 13A:
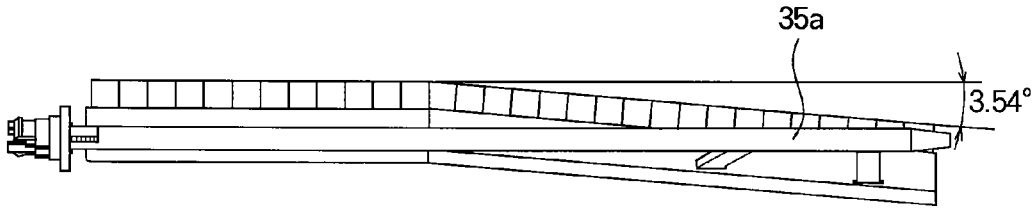
FIGS. 13A-13F illustrate the construction of the agitator and the sheet member.
Figure 13B:
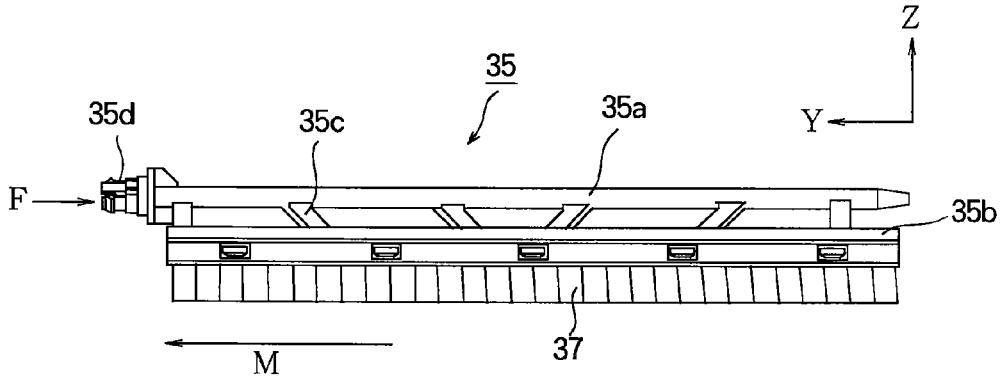
Figure 13C:
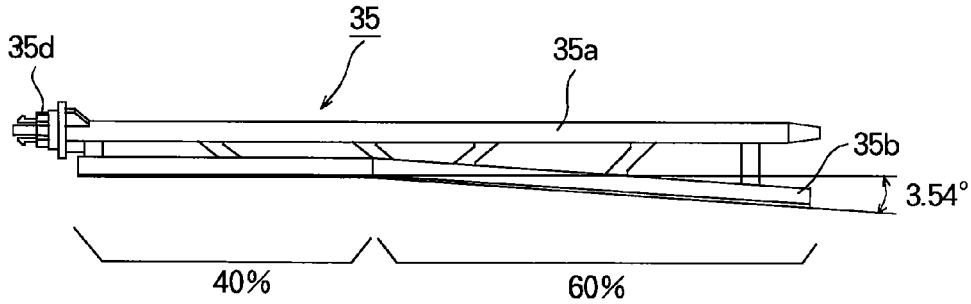
Figure 13D:
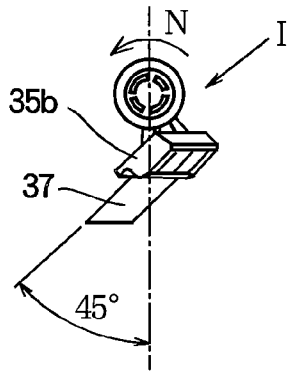
Figure 13E:
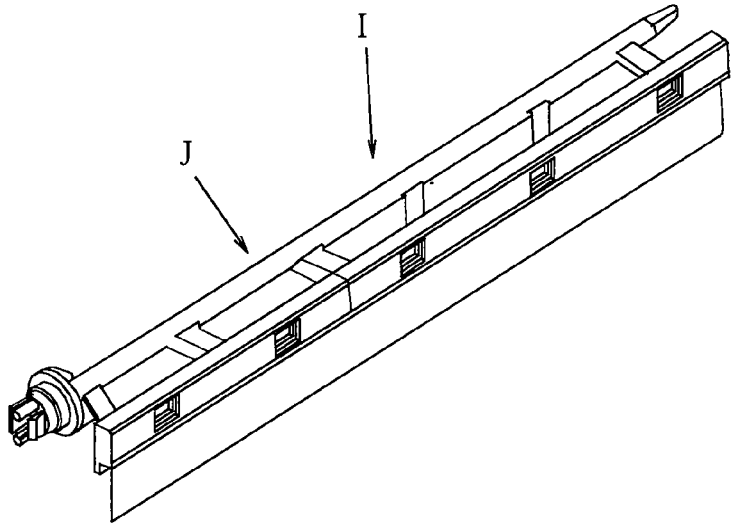
Figure 13F:
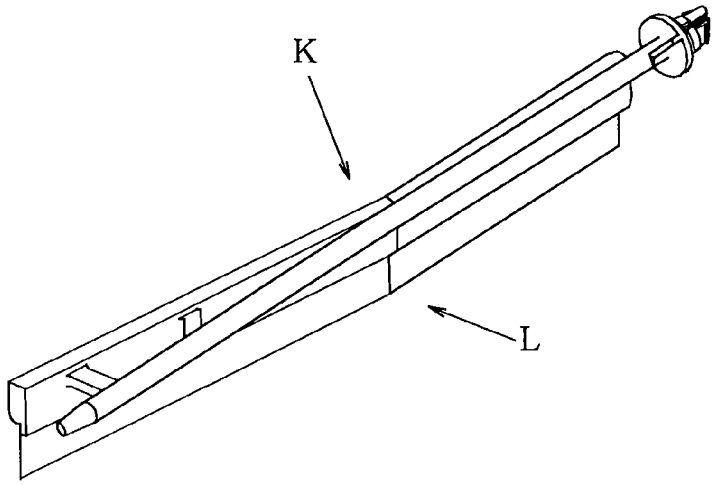

FIG. 13A is a view as seen in a direction shown by arrow L of FIG. 13F.

FIG. 13C is a view of the agitator 35 as seen in a direction shown by arrow I of FIGS. 13D and 13E.

FIG. 13D is a side view as seen in a direction shown by arrow F of FIG. 13B.

FIG. 13E is a perspective view of the agitator 35 as seen in a direction shown by arrow K of FIG. 13F.

FIG. 13F is a perspective view of the agitator 35 as seen in a direction shown by arrow J of FIG. 13E.

Referring to FIGS. 13B and 13C, the agitator 35 includes a shaft 35*a*, a sheet support 35*b*, a coupling member 35*c*, and a mounting piece 35*d* that is to be coupled to the shaft of the gear 34. The support 35*b* supports the sheet member 37.

Referring to FIG. 13C, the support 35*b* includes a first portion that extends in parallel with the shaft 35*a* from the mounting piece 35*d* over essentially 40% of a total length of the shaft 35*a*, and a second portion that extends over essentially 60% of the total length of the shaft 35*a*. The second portion is at an angle in the range of 1-15 degrees with respect to the shaft 35*a*. The angle is selected to be 3.54 degrees in the present embodiment. The support 35*b* supports one side of the sheet member 37 such that the sheet member 37 extends generally in a direction that forms an angle of 45° with a line tangent to the rotational direction of the shaft 35*a*. When the shaft 35*a* rotates, the free end of the sheet member 37 scrapes the inner wall of the fresh toner chamber 31. The angle of 45° is effective in scraping the inner wall with a small load exerted on the sheet member 37. The shaft 35*a* rotates counterclockwise in a direction shown by an arrow N in FIG. 13D, so that the toner in the toner chamber 31 is moved in a direction shown by arrow M in FIG. 13B, i.e., from the right end to the left end. The shaft 35*a*, support 35*b*, coupling member 35*c*, and the mounting piece 35*d* are formed of polyoxymethylene (POM) in one piece construction. The sheet member 37 is formed of, for example, polyethyleneterephthalate (PET).

A gear 29 is accommodated in the gear box 27. The gear 29 is formed in one piece with the shaft 35*a* of the agitator 35, so that the gear 29 rotates about the same rotational axis as the shaft 35*a*. The rotation of the agitator 35 is transmitted to a screw conveyor 38 (FIG. 12B) through the gear 29. When the screw conveyor 38 is rotated, the screw conveyor 38 transports waste toner 58 toward the far end of the waste toner chamber 32 from a waste toner receiving opening 46. Sealing members 40*a* and 40*b* covers the outer surfaces 39*a* and 39*b* of the gear box 27 to prevent the fresh toner 4 (FIG. 2) and the waste toner 58 from entering the gear box 27.

The waste toner chamber 32 includes the screw conveyor 38, a cylinder 42, and a rotary drive shutter 43 received in the cylinder 42. The cylinder 42 is in the form of a cylinder, and includes a waste toner receiving opening 50 (FIGS. 20A and 21A-21D) formed therein. When the rotary drive shutter 43 is rotated, the rotary drive shutter 43 opens and closes the waste toner receiving opening 50.

{Rotary Drive Shutter}

Figure 15A:
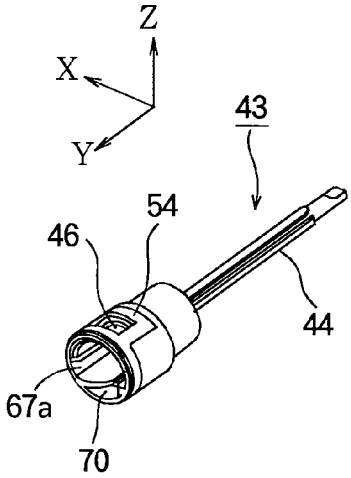
FIGS. 15A-15C are perspective views of the rotary drive shutter as seen from different directions.
Figure 15B:
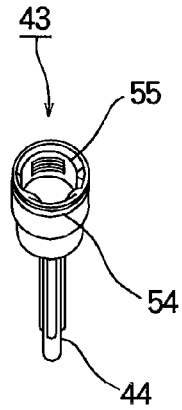
Figure 15C:
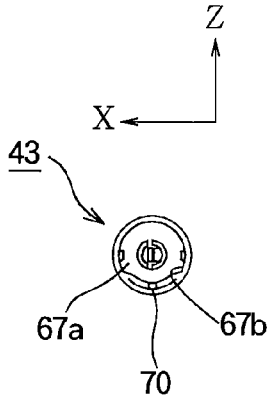
Figure 20A:
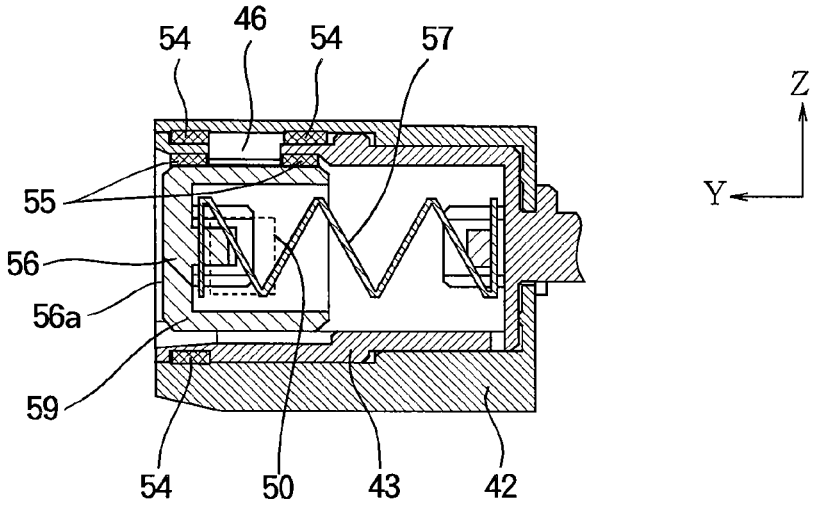
FIGS. 20A and 20B are partial expanded views of the vicinity of the cylinder.
Figure 20B:
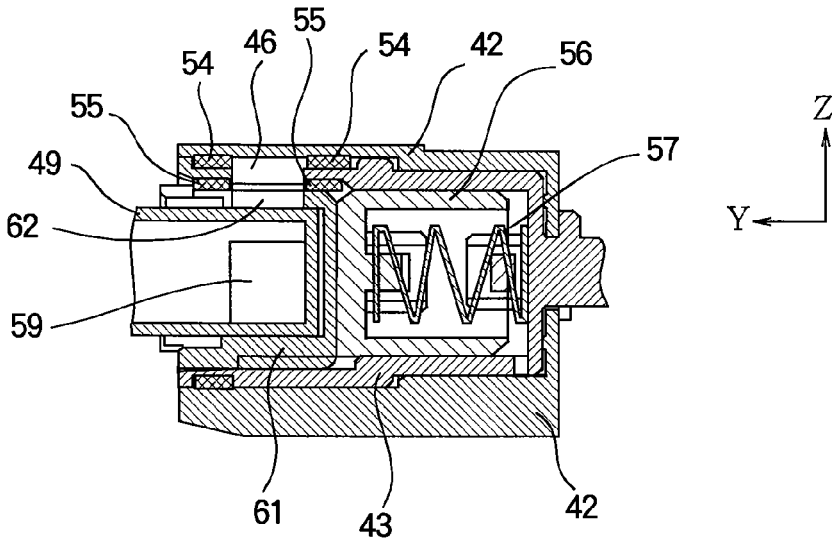

FIGS. 15A-15C are perspective views of the rotary drive shutter 43 as seen from different directions. FIGS. 20A and 20B are partial expanded views of the vicinity of the cylinder 42, and illustrate the opening and closing operations of the rotary drive shutter 43.

Referring to FIGS. 15A-15C, the rotary drive shutter 43 includes the waste toner receiving opening 46 and a shaft 44. The shaft 44 fits into a coupling 45 so that when the fresh toner shutter 33 in the fresh toner chamber 31 opens and closes, the shaft 44 rotates together with the fresh shutter 33. The coupling 45 is operatively coupled to the fresh toner shutter 33, and rotates in the gear box 27 together with the fresh toner shutter 33. The rotary drive shutter 43 also includes a sealing member 54 and a sealing member 55 attached thereto. The sealing member 54 is disposed on the outer surface of the shutter 43, and surrounds the perimeter of the waste toner receiving opening 46. The sealing member 55 is disposed on the inner surface of the rotary drive shutter 43, and surrounds the perimeter of the waste toner receiving opening 46.

{Reciprocating Shutter}

Figure 14:
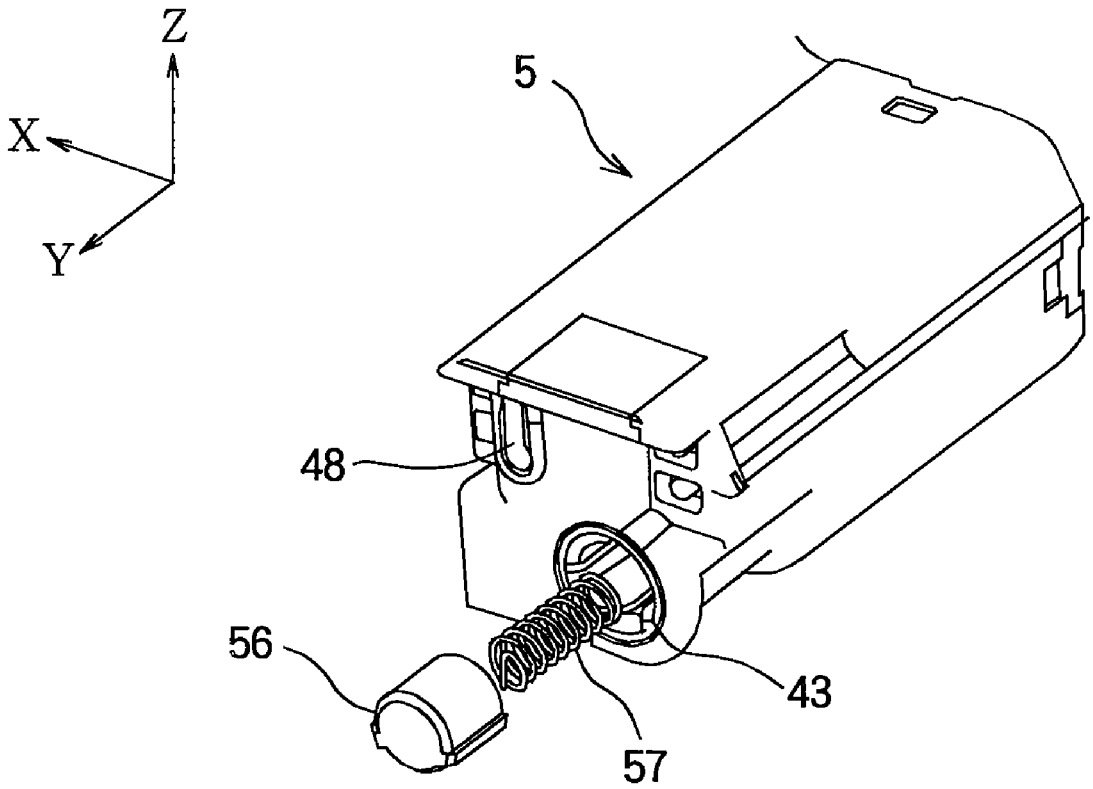
FIG. 14 is a partial exploded perspective view illustrating the rotary drive shutter and the reciprocating shutter.
Figure 16A:
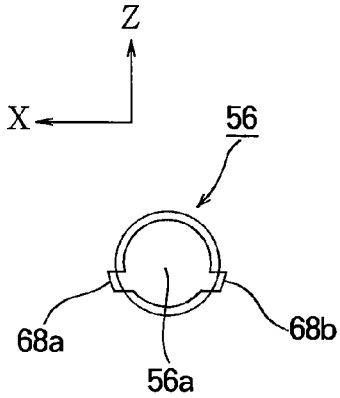
FIGS. 16A and 16B are perspective views of the reciprocating shutter as seen from different directions.
Figure 16B:
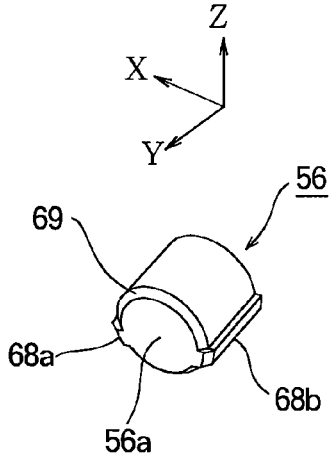

Referring to FIG. 20A, a reciprocating shutter 56 is disposed on the inside of the rotary drive shutter 43, and is urged by a spring 57 such that the rotary drive shutter 43 may move straight to open and close the waste toner receiving opening 46. FIG. 14 is a partial exploded perspective view illustrating the rotary drive shutter 43 and the reciprocating shutter 56. FIGS. 16A and 16B are perspective views of the reciprocating shutter 56 as seen from different directions.

Referring to FIG. 15C, guide grooves 67*a* and 67*b* and a groove 70 are formed in an inner circumferential surface of the rotary drive shutter 43 to extend in directions parallel to the shaft 44. The guide grooves 67*a* and 67*b* are somewhat wider at an open end of the rotary drive shutter 43 than the rest of the guide grooves 67*a* and 67*b*. The groove 70 is somewhat wider at the open end of the rotary drive shutter 43 than the rest of the groove 70, and is beveled at the open end of the rotary drive shutter 43. Referring to FIGS. 16A and 16B, the reciprocating shutter 56 includes ribs 68*a* and 68*b* that are formed on an outer circumferential surface of the reciprocating shutter 56, and a chamfered corner surface 69 that describes a part of a conical surface.

The ribs 68*a* and 68*b* fit into the guide grooves 67*a* and 67*b*, respectively, such that the reciprocating shutter 56 may slide straight in the rotary drive shutter 43. The reciprocating shutter 56 is stopped at a closing position (FIG. 20A) where the outer circular surface 56*a* of the reciprocating shutter 56 is flush with the side surface of the toner cartridge 5. When the reciprocating shutter 56 is at the closing position, the outer cylindrical surface of the reciprocating shutter 56 closes the waste toner discharging opening 46 of the rotary drive shutter 43 while also being in contact with the sealing member 55. When the reciprocating shutter 56 is at the closing position, the spring 57 is in its relaxed state.

Figure 17:
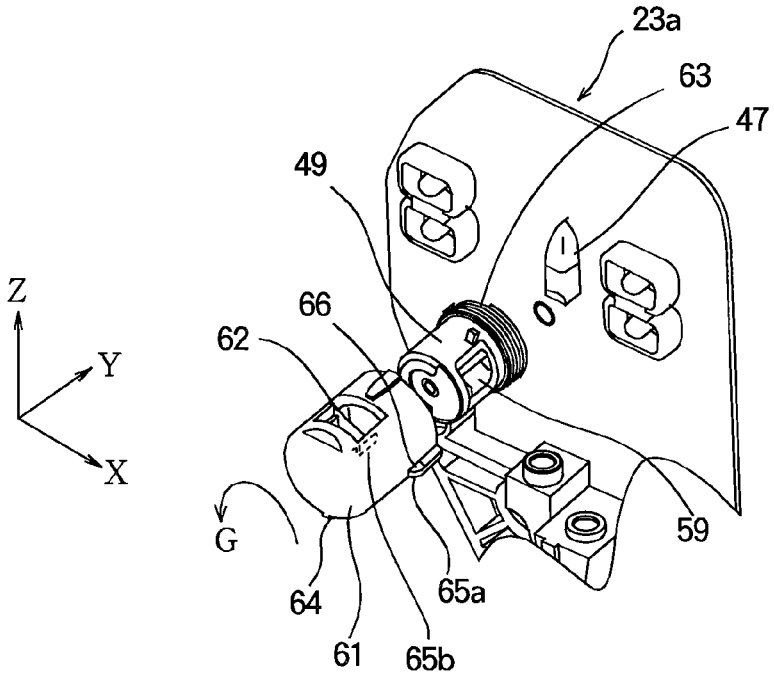
FIG. 17 is a partial expanded view of a waste toner discharging section of the main body of the image forming section.

FIG. 17 is a partial expanded view of a waste toner discharging section 49 of the main body 23*a* of the image forming section 23. Referring to FIG. 17, the waste toner discharging section 49 includes a waste toner discharging opening 59. The waste toner discharging section 49 loosely fits into a shutter 61 such that the shutter 61 is rotatable about the waste toner discharging section 49 to open and close the toner discharging opening 59. For clearly showing the construction, FIG. 17 illustrates the shutter 61 when it is disengaged from the waste toner discharging section 49.

The shutter 61 includes a waste toner discharging opening 62, and is urged by a spring 63 in a direction shown by arrow G such that the shutter 61 is stopped at a rotational position where the shutter 61 just closes the toner discharging opening 59. The shutter 61 includes a lower rib 64 formed on a lower outer surface of the shutter 61. When the shutter 61 is rotated, a rotational force is applied to the lower rib 64 so that the shutter 61 rotates about the toner discharging section 49. The shutter 61 further includes guide ribs 65*a* and 65*b* which are engaged with the guide grooves 67*a* and 67*b* formed in the rotary drive shutter 43, respectively. The lower rib 64 is tapered while the guide rib 65*a* has a beveled portion 66 with a narrower end. The lower rib 64 and guide ribs 65*a* and 65*b* serve as a second guide portion.

{Operation of the Image Forming Apparatus}

The operation of the image forming apparatus 100 of the aforementioned configuration will be described with reference to FIG. 1.

Upon activation of printing, the medium feeding mechanism 22 shown in FIG. 1 feeds the print paper 13 from the medium cassette 20 into the transport path 15. The print paper is transported along the transport path 15. When the print paper passes by the detector 26, the detector 26 detects the thickness of the print paper. Thereafter, the print paper advances onto the transport belt 24, which in turn transports the print paper through the image forming sections 23K, 23Y, 23M, and 23C, so that the toner images of the respective colors are transferred by the transfer rollers 12K, 12Y, 12M, and 12C, respectively, onto the print paper one over the other in registration. The print paper then advances through the fixing unit 25 where the toner images are fixed into a full color permanent image under heat and pressure. Then, the print paper is further transported, and is finally discharged onto the stacker 21.

{Operation of Image Forming Section}

The operation of the image forming section 23K, by way of example, will be described with reference to FIGS. 2 and 7. FIG. 7 is a perspective view of the main body 23*a* of the image forming section 23K when a cover has been removed to show a transport belt 60.

The toner supplying roller 8 receives the toner from the toner cartridge 5, and supplies the toner to the developing roller 6. The developing blade 7 forms a thin layer of toner having a uniform thickness on the developing roller 6. The layer of toner is then brought into contact with the electrostatic latent image, thereby developing the electrostatic latent image into a toner image. The toner image is then transferred electrostatically by the transfer roller 12K onto the print paper 13.

The cleaning blade 9 scrapes the residual toner 4 off the photoconductive drum 1 after transfer, the residual toner being stored as waste toner 58 in a waste toner tank 111. The waste toner 58 in the waste toner tank 111 is transported by a screw conveyor screw 111*a* toward an end of the toner cartridge 5 where the transport belt 60 (FIG. 7) is disposed. The waste toner 58 is further transported by the transport belt 60 in the shape of a caterpillar to the waste toner discharging section 49 (FIG. 17).

{Operation of Toner Cartridge}

The operation of the toner cartridge 5 will be described.

As previously described, the toner cartridge 5 (FIG. 10) is attached to the main body 23*a* (FIG. 7), and supplies the toner 4 through the toner discharging opening 41 into the toner reservoir 112 (FIG. 2).

A description will be given of the operation for opening and closing the toner discharging opening 41 when the toner cartridge 5 is attached to and detached from the main body 23*a*.

Figure 18:
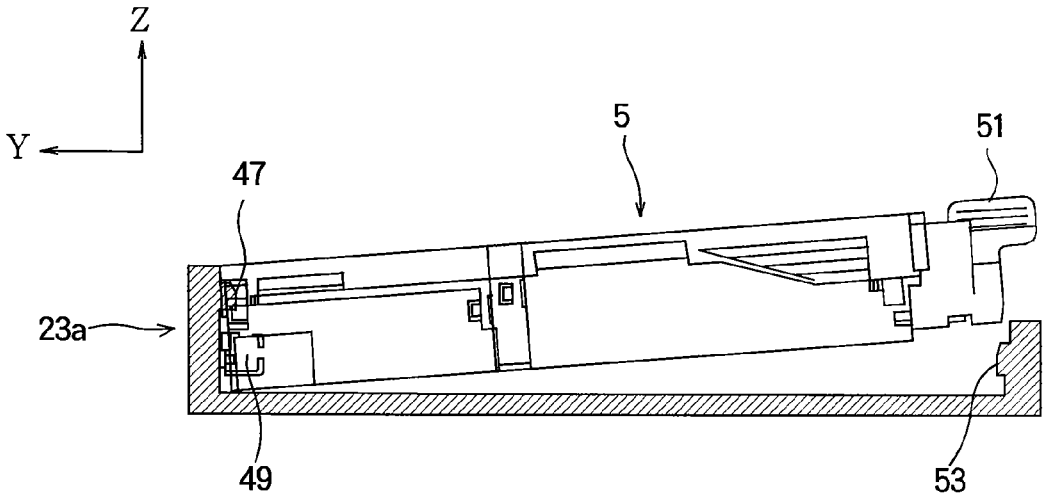
FIG. 18 illustrates when the toner cartridge is attached to and detached from the main body.

FIG. 18 illustrates when the toner cartridge 5 is attached to and detached from the main body 23*a*. When the toner cartridge 5 is attached, the toner cartridge 5 is tilted so that a positioning hole 48 (FIG. 14) of the toner cartridge 5 is brought into engagement with a positioning post 47 of the main body 23*a*. Then, the toner cartridge 5 is displaced with the positioning post 47 fitting into the positioning hole 48, thereby positioning the toner cartridge 5 laterally relative to the main body 23*a*.

Then, the toner cartridge 5 is gradually tilted in the opposite direction so that the toner cartridge 5 lies horizontally and a groove 52 (FIGS. 8 and 9) formed in the lever 51 of the toner cartridge 5 receives a post 53 (FIG. 6) of the main body 23*a*. Then, the lever 51 is rotated about the Y axis in a direction shown by arrow H (FIG. 8) until a lower portion of the post 53 abuts a stopper 116 (FIG. 8).

The rotation of the lever 51 causes the fresh toner shutter 33 (FIG. 11B) to rotate in the same direction, so that the toner discharging opening 41 (FIG. 9) is opened to supply the fresh toner from the fresh toner chamber 31 (FIG. 11B) into the toner reservoir 112 (FIG. 2).

The detachment of the toner cartridge 5 may be accomplished by reversing the aforementioned procedure. In other words, the lever 51 is rotated in the opposite direction to arrow H to unlock the toner cartridge 5. The fresh toner shutter 33 has completely closed the toner discharging opening 41 before the toner cartridge 5 is lifted, preventing the toner inside the toner cartridge 5 from leaking.

Figures 19A, 19B:
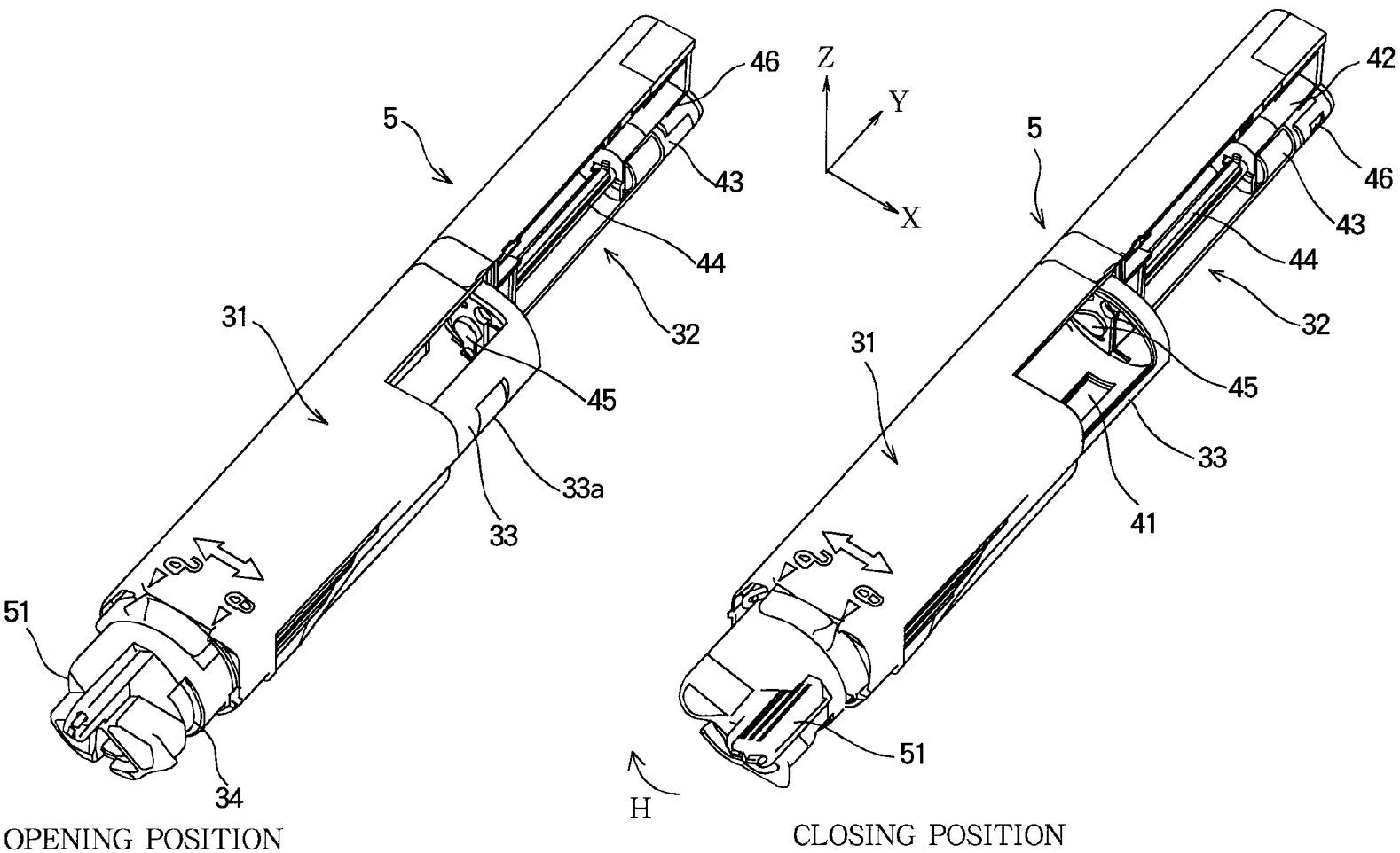
FIG. 19A shows the fresh toner shutter when the fresh toner shutter closes the toner discharging opening.
FIG. 19B shows the fresh toner shutter when the fresh toner shutter opens the toner discharging opening.

FIGS. 19A and 19B illustrate a mechanism inside of the toner cartridge 5 that rotates when the lever 51 is rotated. FIGS. 19A and 19B show the mechanism with part of the outer walls of the fresh toner chamber 31 and waste toner chamber 32 cut away. FIG. 19A shows the fresh toner shutter 33 when the fresh toner shutter 33 closes the toner discharging opening 41, i.e., before the lever 51 is rotated in the H direction. FIG. 19B shows the fresh toner shutter 33 when the fresh toner shutter 33 opens the toner discharging opening 41, i.e., after the lever 51 has been rotated in the H direction. The fresh toner shutter 33 is formed with an opening 33*a* that is aligned with the toner discharging opening 41 when the fresh toner shutter 33 opens the toner discharging opening 41. When the toner cartridge 5 has been attached to the main body 23*a*, the gear 34 (FIG. 11B) of the toner cartridge 5 is in mesh with the drive gear 115 of the main body 23*a*.

A description will be given of the operation in which the waste toner receiving opening 46 and waste toner receiving opening 50 are opened and closed after the toner cartridge 5 has been attached to the main body 23*a*.

When the toner cartridge 5 is attached to the main body 23*a*, the positioning post 47 is received into the positioning hole 48 with the toner cartridge 5 tilting as shown in FIG. 18.

At the same time, the rotary drive shutter 43 (FIGS. 14 and 15A-15C) begins to receive the shutter 61 (FIG. 17) on the waste toner discharging section 49 side. In other words, the guide grooves 67*a* and 67*b* of the rotary drive shutter 43 begin to receive the guide ribs 65*a* and 65*b* of the shutter 61. In addition, the groove 70 (FIGS. 15A-15C) of the rotary drive shutter 43 receives the lower rib 64 (FIG. 17) of the shutter 61.

The lower rib 64 and guide ribs 65*a* and 65*b* include tapered end portions while the grooves 67*a* and 67*b* and 70 include wide mouths and inclined bottoms such that the grooves 67*a* and 67*b* and 70 become deeper farther away from the entrances. Thus, the ribs of the shutter 61 may enter or exit corresponding grooves in the rotary drive shutter 43 without interfering with the surroundings.

When the rotary drive shutter 43 begins to receive the shutter 61, as shown in FIG. 20B, the waste toner discharging section 49 pushes the reciprocating shutter 56 (at a closing position shown in FIG. 20A) into the cylinder 42, so that when the toner cartridge 5 lies horizontally, the reciprocating shutter 56 is at an opening position in FIG. 20B. As a result, the reciprocating shutter 56 opens the waste toner receiving opening 46 formed in the rotary drive shutter 43.

Because the spring 57 urges the reciprocating shutter 56 outwardly of the cylinder 42, when the toner cartridge 5 is detached from the main body 23*a*, the reciprocating shutter 56 moves toward an open end of the cylinder 42 as the waste toner discharging section 49 exits the cylindrical space of the rotary drive shutter 43, and reaches the closing position (FIG. 20A) at which the reciprocating shutter 56 the reciprocating shutter 56 closes the waste toner receiving opening 46. At this moment, the guide grooves 67*a* and 67*b* formed in the rotary drive shutter 43 guide the ribs 68*a* and 68*b* (FIGS. 16A and 16B), facilitating straight movement of the reciprocating shutter 56.

Referring to FIGS. 16B and 20A-20B, the reciprocating shutter 56 has a chamfered portion 69 contiguous with the outer surface 56*a* and a circumferential surface of the reciprocating shutter 56. The chamfered portion 69 prevents the reciprocating shutter 56 interferes with a sealing member 55 when the reciprocating shutter 56 is assembled to the toner cartridge 5 and when the reciprocating shutter 56 moves in the rotary drive shutter 43. FIG. 11B is a cross-sectional view of the toner cartridge 5 when the reciprocating shutter 56 is at its opening position. FIG. 12B is a cross-sectional view of the toner cartridge 5 when the reciprocating shutter 56 is at its closing position.

Referring to FIGS. 11B and 19A, when the lever 51 is rotated in the H direction (FIG. 19A), the drive force is transmitted to the rotary drive shutter 43 via the fresh toner shutter 33 and the coupling 45 so that the rotary drive shutter 43 rotates. As the rotary drive shutter 43 rotates, the waste toner receiving opening 46 rotates from the closing position shown in FIG. 19A to the opening position shown in FIG. 19B. When the waste toner receiving opening 46 is at the opening position, the waste toner receiving opening 46 is aligned with the waste toner receiving opening 50 (FIGS. 20A and 21A-21D) formed in the cylinder 42, so that the inner space of the waste toner discharging section 49 is brought into communication with the waste toner chamber 32 through the waste toner receiving opening 46.

The rotation of the lever 51 in the H direction is transmitted to the shutter 61 that fits over the waste toner discharging section 49. Referring to FIG. 20B, because the lower rib 64 (FIG. 17) of the shutter 61 is received in the groove 70 (FIGS. 15A-15C), rotating the rotary drive shutter 43 causes the shutter 61 to rotate together with the rotary drive shutter 43.

The waste toner discharging opening 59 of the waste toner discharging section 49 received in the rotary drive shutter 43 is formed at a position where the waste toner discharging opening 59 is in line with the waste toner receiving opening 50. The waste toner discharging opening 62 formed in the shutter 61 is at a position where the waste toner discharging opening 62 is in line with the waste toner receiving opening 46 formed in the rotary drive shutter 43. When the lever 51 is rotated in the H direction, the waste toner receiving opening 46 and the waste toner discharging opening 62 rotate from the closing position (FIG. 19A) to the opening position (FIG. 19B), so that the waste toner discharging opening 59 and the waste toner receiving opening 50 are brought into communication with each other.

Rotating the lever 51 in the opposite direction to the H direction causes the toner discharging opening 41 to close, the rotary shutter 43 rotating in the opposite direction to close the waste toner receiving opening 50 of the cylinder 42. This operation will be described later in detail.

{Operation of Agitator}

As described above, the toner cartridge 5 is attached to the main body 23*a*, and is then locked to the main body 23*a* by operating the lever 51. Then, when the image forming section 23K starts to operate, the gear 34 of the toner cartridge 5 in mesh with the drive gear 115 of the main body 23*a* starts to rotate to drive the agitator 35 into rotation. As the agitator 35 rotates, the toner 4 in the fresh toner chamber 31 is directed to the toner discharging opening 41 that has been opened. Thus, the toner 4 is supplied through the toner discharging opening 41 into the toner reservoir 112 (FIG. 2). As the agitator 35 rotates, the end of sheet member 37 rubs the inner wall 36 (FIG. 11B) to scrape the toner off the inner wall 36.

Referring to FIG. 11B, the rotation of the agitator 35 causes the gear 29 in the gear box 27 to transmit the drive force to the screw conveyor 38 in the waste toner chamber 32, so that the screw conveyor 38 rotates to transport the waste toner 58 from the waste toner receiving opening 50 toward the far end of the waste toner chamber 32.

{Transportation of Waste Toner}

FIGS. 21A-21D illustrate the waste toner 58 that is transported between the waste toner discharging section 49 of the main body 23*a* and the waste toner chamber 32 of the toner cartridge 5. The transportation of the waste toner 58 will be described with reference to FIGS. 21A-21D.

As described above, the waste toner 58 is discharged into the waste toner chamber 32 through the waste toner discharging opening 59 formed in the waste toner discharging section 49. The waste toner 58 is then delivered into the waste toner chamber 32 of the toner cartridge 5 through the waste toner discharging opening 62 formed in the shutter 61, the waste toner receiving opening 46 formed in the rotary drive shutter 43, and the waste toner receiving opening 50 formed in the cylinder 42. Some of the waste toner 58 may remain in the vicinity of the waste toner receiving opening 46 and the waste toner discharging opening 62.

When some of the waste toner 58 remains in the vicinity of the waste toner receiving opening 46 and the waste toner discharging opening 62, if the lever 51 is rotated in the opposite direction to the H direction from the opening position (FIG. 19B) to the closing position (FIG. 19A), the toner discharging opening 41 and the shutter 61 rotate to close the waste toner discharging opening 59 and the waste toner receiving opening 50 as shown in FIG. 21B. The waste toner 58 remaining in the vicinity of the waste toner receiving opening 46 and the waste toner discharging opening 62 is scooped upward as shown in FIG. 21B.

As the toner cartridge 5 shown in FIG. 20B is detached from the main body 23*a*, the reciprocating shutter 56 moves straight toward the open end of the rotary drive shutter 43, closing the waste toner receiving opening 46 in the rotary drive shutter 43. This operation prevents spillage of the scooped waste toner 58 which would otherwise stay on the reciprocating shutter 56 as shown in FIG. 21C and spill out of the toner cartridge 5 if the toner cartridge 5 is tilted.

The sealing member 55 (FIGS. 20A and 20B) is formed on the inner surface of the rotary drive shutter 43 all around the waste toner receiving opening 46, and is in contact with the outer surface of the shutter 61. Thus, most of the scooped waste toner 58 except for that received in a space defined by the depth of the waste toner discharging opening 62 is prevented from moving, and therefore remains on the outer surface of the reciprocating shutter 56. When the reciprocating shutter 56 is at the closing position, the sealing member 55 is in pressure contact with the outer circumferential surface of the reciprocating shutter 56, preventing the waste toner 58 on the reciprocating shutter 56 from leaking to outside.

After the toner cartridge 5 has been detached from the main body 23*a*, the shutter 61 closes the waste toner discharging opening 59 formed in the waste toner discharging section 49, and the waste toner discharging opening 62 formed in the shutter 61 faces upward. Thus, the waste toner 58 will not leak through the waste toner discharging opening 59. A small amount of the waste toner 58 remains on the reciprocating shutter 56 but will not leak outside of the space of the waste toner receiving opening 46.

If the toner cartridge 5 did not include the reciprocating shutter 56, the toner cartridge 5 would suffer the following drawbacks. When the toner cartridge 5 is detached from the main body 23*a*, the waste toner 58 scooped in the waste toner receiving opening 46 positioned at an upper side of the waste toner chamber 32 falls within the rotary drive shutter 43 due to vibration during attachment and detachment of the toner cartridge 5 and/or vibration added to the toner cartridge 5 and tilting of the toner cartridge 5.

In the first embodiment, the toner cartridge 5 has been described in terms of the configuration in which the cylinder 42 is provided with the reciprocating shutter 56. The invention is not limited to this and the same configuration may be applied to a structure from which the fresh toner is supplied.

As described above, when the toner cartridge 5 is detached from the main body 23*a* of the image forming section, the toner cartridge 5 may be detached without spilling the toner. The waste toner 58 adhering to the waste toner discharging section 49 is also prevented from falling down.

Second Embodiment

Figure 22A:
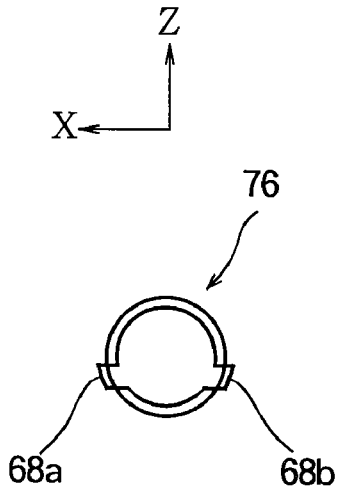
FIGS. 22A and 22B are perspective views of a reciprocating shutter of a second embodiment as seen from different directions.
Figure 22B:
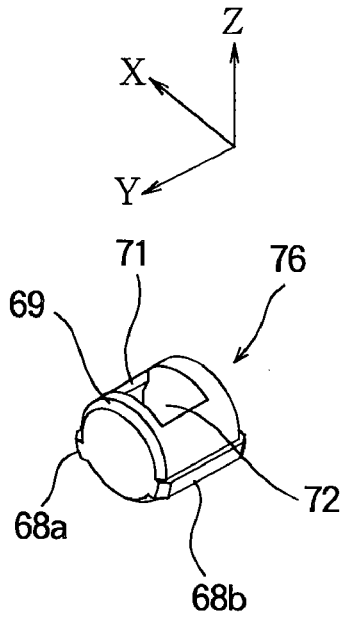

FIGS. 22A and 22B are perspective views of a reciprocating shutter 76 of a second embodiment as seen from different directions.

A toner cartridge 5 of the second embodiment differs from that of the first embodiment in that the reciprocating shutter 76 shown in FIGS. 22A and 22B is used. Elements similar to those of the first embodiment have been given the same reference numerals and their description is omitted.

{Transportation of Waste Toner}

Figure 23A:
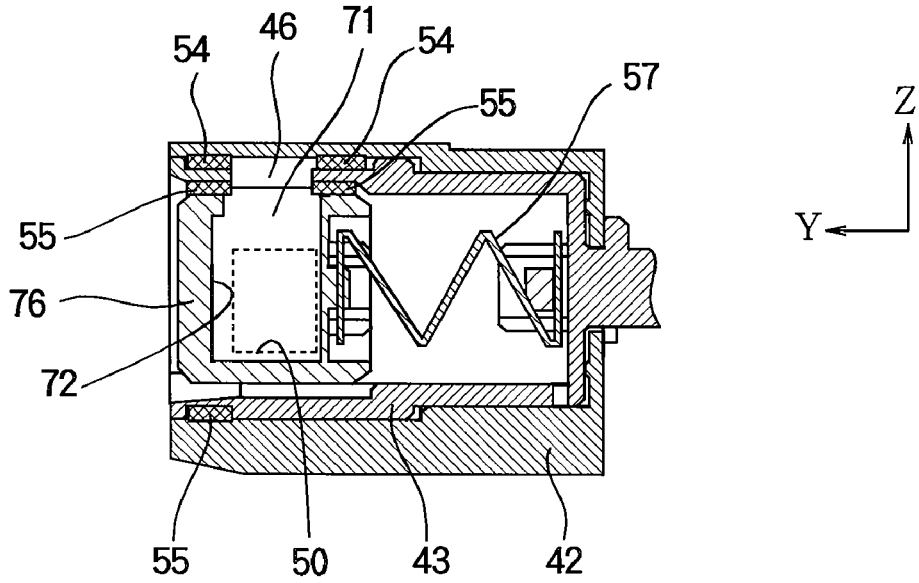
FIGS. 23A and 23B illustrate the operation of the reciprocating shutter.
Figure 23B:
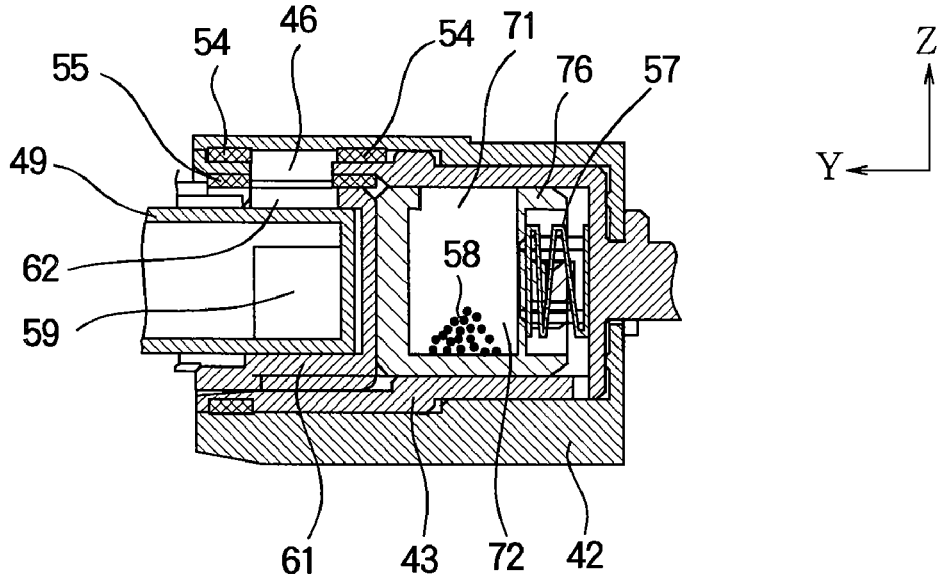

FIGS. 23A and 23B illustrate the operation of the reciprocating shutter 76. Referring to FIGS. 23A and 23B, the reciprocating shutter 76 is slidably received in a rotary drive shutter 43. The reciprocating shutter 76 includes an inner space 72 and a waste toner receiving opening 71 in an upper portion of the reciprocating shutter 76.

FIGS. 24A-24D illustrate waste toner 58 that is transported between a waste toner discharging section 49 of a main body 23*a* and a waste toner chamber 32 of the toner cartridge 5. The transportation of the waste toner 58 will be described with reference to FIGS. 23A-23B and 24A-24D.

The toner cartridge 5 (FIG. 8) is attached to the main body 23*a* (FIG. 6) and then a lever 51 is rotated in H direction to lock the toner cartridge to the main body 23*a*, so that a waste toner discharging opening 59 of the waste toner discharging section 49 of an image forming section 23K is aligned with a waste toner receiving opening 50 formed in a cylinder 42 of the toner cartridge 5. Thus, the waste toner 58 is discharged through the waste toner discharging opening 59 formed in the waste toner discharging section 49, a waste toner discharging opening 62 formed in a shutter 61, a waste toner receiving opening 46 of the rotary drive shutter 43, and the waste toner receiving opening 50 formed in the cylinder 42, into the waste toner chamber 32 of the toner cartridge 5. Some of the waste toner 58 may remain in the vicinity of the waste toner discharging opening 62 and the waste toner receiving opening 46.

When some of the waste toner 58 remains in the vicinity of the waste toner discharging opening 62 and the waste toner receiving opening 46, if the lever 51 is rotated in the opposite direction to the A direction from the FIG. 19B position to the FIG. 19A position, a toner discharging opening 41 and the shutter 61 rotate to close the waste toner discharging opening 59 and the waste toner receiving opening 50 as shown in FIG. 24B. The waste toner 58 remaining in the vicinity of the waste toner receiving opening 46 and the waste toner discharging opening 62 is scooped up as shown in FIG. 24B.

As the toner cartridge 5 shown in FIG. 23B is detached from the main body 23*a*, the reciprocating shutter 76 moves straight following the waste toner discharging section 49, closing the waste toner receiving opening 46 formed in the rotary drive shutter 43. At this moment, the waste toner receiving opening 71 formed in the reciprocating shutter 76 is immediately below the waste toner receiving opening 46 formed in the rotary drive shutter 43. Thus, the waste toner 58 falls into the inner space 72 of the reciprocating shutter 76 as shown in FIG. 23B, being prevented from spilling outside of the toner cartridge 5.

The sealing member 55 (FIGS. 20A-20B) is formed on the inner surface of the rotary drive shutter 43 all around the waste toner receiving opening 46, and is in contact with the outer surface of the shutter 61. Thus, most of the scooped waste toner 58 except for that received in a space defined by the depth of the waste toner discharging opening 62 is prevented from moving, and is stored in the inner space 72 of the reciprocating shutter 76.

The waste toner receiving opening 71 is larger than the waste toner receiving opening 46 of the rotary drive shutter 43, so that the waste toner 58 may be collected irrespective of variations of the position of the reciprocating shutter 76 and/or the urging force of a spring 57.

As described above, when the toner cartridge 5 is detached from the main body 23*a* of the image forming section, the toner cartridge 5 may be detached without spilling toner. After the toner cartridge 5 has been detached from the main body 23*a*, the waste toner 58 will not spill outside of the toner cartridge 5 even when the operator inadvertently pushes the reciprocating shutter 76 with his hand, because the scooped waste toner 58 is accommodated in the inner space 72 of the reciprocating shutter 76.

Third Embodiment

Figure 25A:
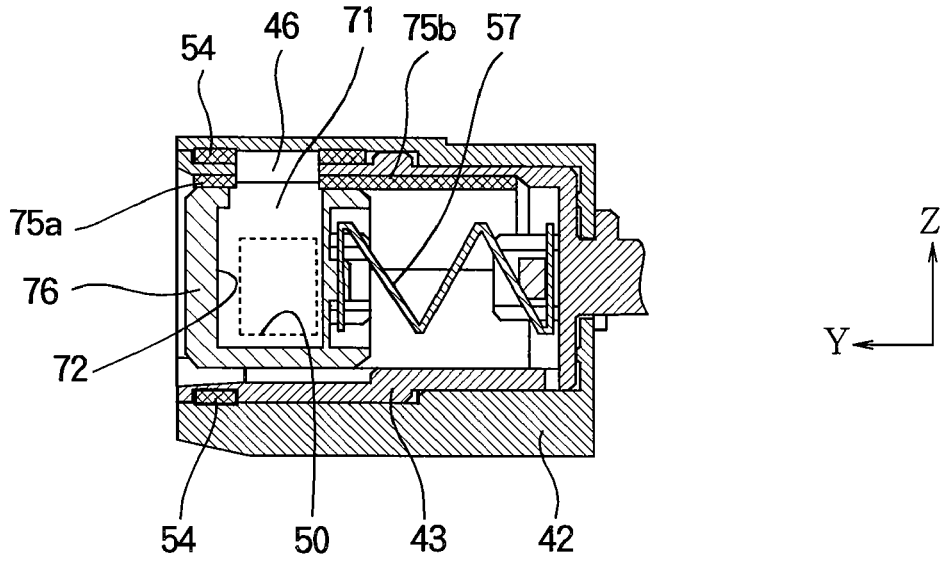
FIGS. 25A and 25B illustrate the operation of a toner cartridge of a third embodiment and a reciprocating shutter provided on a main body side of an image forming section.
Figure 25B:
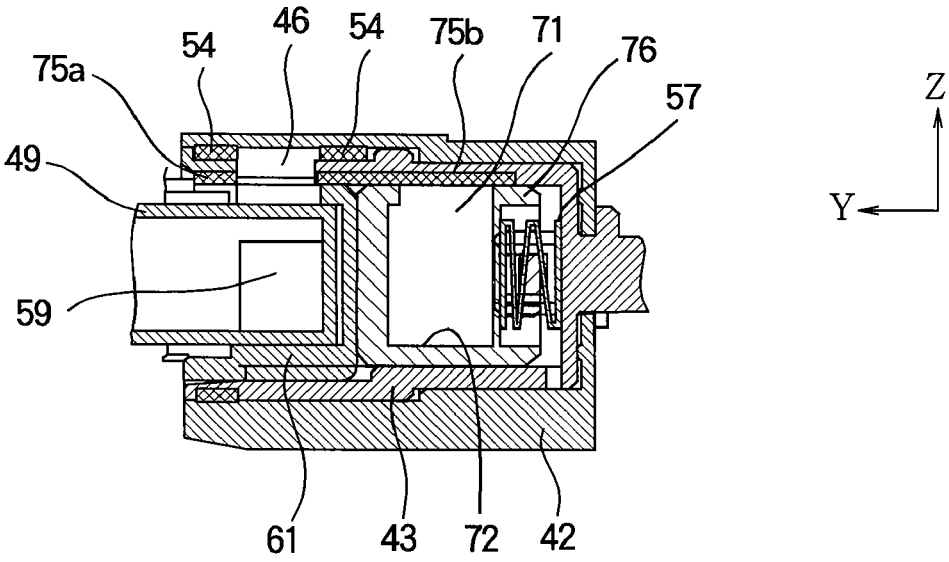

FIGS. 25A and 25B illustrate the operation of a toner cartridge 5 of a third embodiment and a reciprocating shutter 76 provided on a main body 23*a* side of an image forming section.

The toner cartridge 5 of the third embodiment differs from that of the first embodiment in that the reciprocating shutter 76 (FIGS. 22A-22B) is used, and in that sealing members 75*a* and 75*b* are formed all around a waste toner receiving opening 46. The sealing member 75*a* and 75*b* differ in shape from the sealing member 55 of the first embodiment. Thus, elements similar to those of the first embodiment have been given the same reference numerals and their description is omitted.

Referring to FIGS. 25A and 25B, the reciprocating shutter 76 is slidably received in a rotary drive shutter 43 (FIGS. 15A-15C, FIGS. 25A and 25B). The reciprocating shutter 76 includes an inner surface 72 and a waste toner receiving opening 71. The waste toner receiving opening 71 is somewhat larger than the waste toner receiving opening 46 formed in the rotary drive shutter 43.

The sealing members 75*a* and 75*b* are formed on the inner surface of the rotary drive shutter 43. The sealing member 75*a* is near the mouth of the rotary drive shutter 43, and has the same shape and size as the sealing member 55 (FIGS. 20A-20B) of the first embodiment. The sealing member 75*b* is near the far end of the rotary drive shutter 43 extends along and across the path (i.e., stroke) of the reciprocating shutter 76 in which the waste toner receiving opening 71 moves back and forth straight as well as over the circumferential path in which the waste toner receiving opening 71 rotates.

When the toner cartridge 5 is detached from the main body 23*a*, a lever 51 is rotated in the opposite direction to the H direction from a closing position (FIG. 19B) to an opening position (FIG. 19A), thereby unlocking the toner cartridge 5 from the main body 23*a*. Waste toner 58 is transported between the waste toner discharging section 49 of the main body 23*a* and the waste toner chamber 32 of the toner cartridge 5 in exactly the same way as the second embodiment, and therefore the description is omitted.

When the toner cartridge 5 is attached to the main body 23*a* again, the reciprocating shutter 76 moves straight from the closing position in FIG. 25A to the opening position in FIG. 25B as the waste toner discharging section 49. Then, operating the lever 51 causes the rotary drive shutter 43 to rotate together with the shutter 61, so that the waste toner receiving opening 71 above the reciprocating shutter 76 also rotate. As a result, the waste toner receiving opening 71, the rotary drive shutter 43, the waste toner receiving opening 46, and the waste toner discharging opening 62 are aligned as shown in FIG. 24A.

At this moment, if more than a certain amount of the waste toner 58 is scooped up in the inner space 72 in the reciprocating shutter 76, the waste toner 58 will reach the waste toner receiving opening 71. Because the sealing member 75*b* extends to cover the stroke range in which the waste toner receiving opening 71 moves back and forth, the sealing member 75*b* prevents the waste toner 58 in the inner space 72 from spilling out of the inner space 72.

The reciprocating shutter 76 remains in contact with the sealing members 75*a* and 75*b* during its opening and closing operation. Therefore, when the reciprocating shutter 76 is opened and closed, a spring 57 applies a sufficient urging force to overcome the friction between the reciprocating shutter 76 and the sealing members 75*a* and 75*b*, so that the reciprocating shutter 76 may move straight without difficulty.

As described above, the toner cartridge 5 may be detached from a developing unit without the waste toner 58 leaking or spilling from the toner cartridge 5. In addition, because the waste toner 58 scooped up in the reciprocating shutter 76 remains confined in the reciprocating shutter 76, even if the operator pushes the reciprocating shutter 76 with his hand, the spring 57 pushes back the reciprocating shutter 76 so that waste toner 58 will not spill out of the toner cartridge 5. Further, when the toner cartridge 5 is attached to and detached from the main body 23*a* repeatedly, the waste toner 58 is prevented from spilling out of the toner cartridge 5, so that the waste toner 58 will not spill out of the toner cartridge 5.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A powder material agitator, comprising:

a shaft extending in a longitudinal direction thereof, and rotatable about a longitudinal axis thereof, a sheet member extending generally in the longitudinal direction and including a first longitudinally extending portion and a second longitudinally extending portion contiguous to the first longitudinally extending portion, and a support formed on the shaft and extending generally in the longitudinal direction, wherein the support includes a third longitudinally extending portion that extends substantially parallel to the shaft and holds a first widthwise end portion of the first longitudinally extending portion and a fourth longitudinally extending portion contiguous to the third longitudinally extending portion, wherein the fourth longitudinally extending portion extends away from the shaft in a direction at an angle with the shaft and holds a second widthwise end portion of the second longitudinally extending portion, and wherein the first and second longitudinally extending portions lie in different planes.

2. A powder material cartridge incorporating the powder material agitator according to claim 1, wherein a powder material chamber holds a powder material therein, and wherein the powder material agitator agitates the powder material in the powder material chamber.

3. The powder material cartridge according to claim 2, wherein when the shaft rotates, another end of the sheet member scrapes an inner wall of the powder material chamber.

4. A developing apparatus incorporating the powder material cartridge according to claim 3, wherein the powder material cartridge is detachably attached to the developing apparatus.

5. An image forming apparatus incorporating the developing apparatus according to claim 4.

6. A developing apparatus incorporating the powder material cartridge according to claim 2, wherein the powder material cartridge is detachably attached to the developing apparatus.

7. An image forming apparatus incorporating the developing apparatus according to claim 6.

8. The powder material agitator according to claim 1, wherein the support is connected to the shaft by means of coupling members so that the support is spaced apart from the shaft by a distance.

9. The powder material agitator according to claim 8, wherein the coupling members are aligned in a direction substantially parallel to the longitudinal axis and are spaced-apart.

10. The powder material agitator according to claim 9, wherein a distance between the fourth longitudinally extending portion and the shaft is longer than a distance between the third longitudinally extending portion and the shaft.

11. The powder material agitator according to claim 1, wherein the fourth longitudinally extending portion is longer than the third longitudinally extending portion.

12. The powder material agitator according to claim 1, wherein the angle is in the range of 1-15 degrees.

13. The powder material agitator according to claim 1, wherein the support and shaft extend substantially in a single plane.

* * * * *